US005244781A

United States Patent [19]

Takada

[11] Patent Number: 5,244,781

[45] Date of Patent: Sep. 14, 1993

[54] SILVER HALIDE PHOTOGRAPHIC EMULSION AND SILVER HALIDE PHOTOGRAPHIC LIGHT-SENSITIVE MATERIAL

[75] Inventor: Shunji Takada, Ashigara, Japan

[73] Assignee: Fuji Photo Film Co., Ltd., Kanagawa, Japan

[21] Appl. No.: 628,010

[22] Filed: Dec. 17, 1990

[30] Foreign Application Priority Data

Dec. 19, 1989 [JP] Japan ..... 1-328904

[51] Int. Cl.[5] ..... G03C 1/09

[52] U.S. Cl. ..... 430/567; 430/581; 430/605; 430/603; 430/611

[58] Field of Search ..... 430/567, 611, 603, 608, 430/581, 605, 569, 607, 943

[56] References Cited

U.S. PATENT DOCUMENTS

| | | | |
|---|---|---|---|
| 3,957,490 | 5/1976 | Libeer et al. | 430/569 |
| 4,198,240 | 4/1980 | Mikawa | 430/570 |
| 4,349,622 | 9/1992 | Koitabashi et al. | 430/567 |
| 4,444,865 | 4/1984 | Silverman et al. | 430/217 |
| 4,477,564 | 10/1984 | Cellone et al. | 430/567 |
| 4,565,778 | 1/1986 | Miyamoto et al. | 430/567 |
| 4,639,416 | 1/1987 | Yoshida et al. | 430/567 |
| 4,668,614 | 5/1987 | Takada et al. | 430/567 |
| 4,678,745 | 7/1987 | Yamada et al. | 430/607 |
| 4,681,838 | 7/1987 | Mifune et al. | 430/567 |
| 4,713,318 | 12/1987 | Sugimoto et al. | 430/567 |
| 4,814,264 | 3/1989 | Kishida et al. | 430/567 |
| 4,847,189 | 7/1989 | Suzuki et al. | 430/567 |
| 5,081,009 | 1/1992 | Tanemura et al. | 430/603 |

FOREIGN PATENT DOCUMENTS

| | | |
|---|---|---|
| 164760 | 12/1985 | European Pat. Off. . |
| 348934 | 1/1990 | European Pat. Off. . |
| 369424 | 5/1990 | European Pat. Off. . |

OTHER PUBLICATIONS

Zeitschrift fur wissenschaftliche Photographie, vol. 63, No. 7-9, 1969, DD pp. 133-148; Siegfried Gahler: "Benzolthiolsulfonsaure und Reduktionssensibilisierung".

*Primary Examiner*—Charles L. Bowers, Jr.
*Assistant Examiner*—Mark F. Huff
*Attorney, Agent, or Firm*—Birch, Stewart, Kolasch & Birch

[57] ABSTRACT

A silver halide photographic emulsion contains chemically sensitized silver halide grains each of which has at least one structure resulting from the difference in halogen compositions. The grains have been prepared in the presence of an oxidizing agent for silver. A silver halide photographic light-sensitive material has at least one layer of the silver halide emulsion on a support.

14 Claims, No Drawings

SILVER HALIDE PHOTOGRAPHIC EMULSION AND SILVER HALIDE PHOTOGRAPHIC LIGHT-SENSITIVE MATERIAL

BACKGROUND OF THE INVENTION

1. Field of the Invention

The present invention relates to a silver halide photographic light-sensitive material and, more particularly, to a high-sensitive, high-contrast, low-fog silver halide photographic light-sensitive material containing grains having a structure due to the difference in halogen compositions, wherein the grains are formed in the presence of an oxidizing agent capable of oxidizing silver. 2. Description of the Related Art Basic properties required for a silver halide photographic light-sensitive material are high sensitivity, and low fog. High contrast is also an important property for the material. JP-A-60-143331 discloses a high sensitive silver halide emulsion having low-fog characteristic which contains layered grains, each grain consisting of a core having a high silver iodide content and an outermost shell having a silver iodide content lower than the core. (Hereinafter "JP-A" means Unexamined Published Japanese Patent Application.) These layered grains are desirable in terms of photographic sensitivity, but they have been found to have internal electron traps resulting from the structure due to the difference in the halogen compositions present in the internal portion of the grains. Further, these grains have been found to have disadvantages such as low contrast due to the internal traps.

Silver halide grains of another type are disclosed in U.S. Pat. Nos. 4,094,684, 4,142,900, 4,435,501, and 4,463,087. Each of these grains comprises a substrate grain having epitaxially grown portions different in the halogen composition. These grains are advantageous in terms of photographic sensitivity, but not in terms of contrast. This is because internal electron traps are formed at the interface between the substrate grain and the epitaxial portions as the epitaxial portions are gradually grown on the substrate grain.

JP-B-58-1410 discloses the technique of using both a reducing agent and an oxidizing agent while forming silver halide grains. (Hereinafter "JP-B" means Examined Published Japanese Patent Application.) Described as examples of the oxidizing agents are: iodine, potassium hexacyano ferrate (III), bromosuccinimide, p-quinone, and potassium periodate. This publication, however, is silent about the usefulness of the oxidizing agent when it is not used together with the reducing agent. Nor does the publication disclose any combination of grains having the internal structure with the oxidizing agent for silver. Further, JP-A-61-3136 also discloses the technique of using an oxidizing agent, such as hydrogen peroxide, while forming silver halide grains. However, this publication does not teach the advantageous effects derived from the combination of the grains having the structure with the oxidizing agent for silver.

SUMMARY OF THE INVENTION

It is an object of the present invention to provide high-sensitive, low-fog silver halide photographic light-sensitive emulsion and material.

It is another object of the invention to provide high-sensitive, high-contrast silver halide photographic light-sensitive emulsion and material.

These objects are achieved according to the present invention by a silver halide photographic emulsion comprising chemically sensitized silver halide grains each of which has at least one structure resulting from the difference in halogen compositions, the grains having been prepared in the presence of an oxidizing agent for silver.

The present invention also provides a silver halide photographic light-sensitive material comprising a support and at least one silver halide emulsion layer formed on the support, said emulsion layer containing chemically sensitized silver halide grains each of which has at least one structure resulting from the difference in halogen compositions, the grains having been prepared in the presence of an oxidizing agent for silver.

In a preferred embodiment, the oxidizing agent for silver is at least one selected from the group consisting of compounds represented by formulas [I], [II] and [III], and polymers having as a repeating unit a divalent group derived from the compounds of formula [I], [II] or [III]:

$$R—SO_2S—M \quad (I)$$

$$R—SO_2S—R^1 \quad (II)$$

$$RSO_2S—Lm—SSO_2—R^2 \quad (III)$$

where R, $R^1$, and $R^2$ are either the same or different and represent an aliphatic group, an aromatic group, or a heterocyclic group, M represents a cation, L represents a divalent linking group, and m is 0 or 1, wherein R, $R^1$, $R^2$ and L may combine together, forming a ring.

In another preferred embodiment, the structure resulting from the difference in halogen compositions comprises a layered structure including a core portion and at least one shell portion, wherein the core and at least one layer of the shell portion have different halogen compositions.

In still another preferred embodiment, the structure resulting from the difference in halogen compositions comprises an epitaxial structure including a substrate grain and a portion epitaxially grown on the substrate grain, wherein the substrate grain and the epitaxially grown portion have different halogen compositions.

In still another preferred embodiment, tabular grains having an aspect ratio of 3 or more account for 60% or more of the total projected surface area of the grains having at least one structure resulting from the difference in halogen compositions.

In still another preferred embodiment, a size distribution of the grains having at least one structure resulting from the difference in halogen compositions is monodisperse with a variation coefficient of 25% or less.

DETAILED DESCRIPTION OF THE PREFERRED EMBODIMENTS

The present invention will now be described in detail.

The silver halide photographic emulsion according to the invention contains grains each have a structure resulting from the difference in halogen compositions, i.e., distribution or structure in terms of halogen compositions.

Specific examples include a silver halide emulsion containing grains in which the structure resulting from the difference in halogen compositions comprises a layered structure including a core portion and at least one shell portion, wherein the core and the shell portions have different halogen compositions at an interface. Typical examples are core-shell type or double structured type grains in which halogen compositions of an inner portion and a surface layer portion are different from each other, as disclosed in JP-B-43-13162, JP-A-61-215540, JP-A-60-222845, JP-A-61-75337, and JP-A-60-14331. In such a grain, the core may have a shape the same as, or different from, a shape of the entire grain covered with the shell (shelled grain). More specifically, the core may be cubic, while the shelled grain may be cubic or octahedral. Conversely, the core may be octahedral, while the shelled grain may be cubic or octahedral. Further, the core may have a regular shape, whereas the shelled grain may be deformed or may have no definite shape. Moreover, instead of a simple double layered structure each grain can have a triple-layered structure as disclosed in JP-A-60-222844, or may have more multiple layers. Furthermore, a silver halide having a different composition ma be thinly formed on the surface of the core-shell double structured grain.

Another specific example of the grain having the structure resulting from the difference in halogen compositions is the grain having an epitaxial structure as described earlier, or so-called "junction structure". Such grains are disclosed in JP-A-59-133540, JP-A-58-108526, EP 199290A2, JP-B-58-24772, and JP-A-59-16254. A junction crystal having a composition different from that of a host crystal can be formed on an edge, corner, or face of the host crystal, no matter whether the host crystal has a homogeneous halogen composition or a core-shell structure.

In the case of a silver iodobromide grain having the structure, for example, the core-shell grain, described above, the core portion preferably has a silver iodide content higher than the shell portion. Conversely, the core may have a low silver iodide content, while the shell portion has a high silver iodide content. If the silver iodobromide grain has a junction structure, the host crystal may have a higher silver iodide content than the junction crystal, or vice versa.

In a grain having the above structure, a boundary portion between portions of different halogen compositions may be distinct or not due to a mixed crystal formation by the composition difference. Alternatively, the grain may have continuous structural differences intentionally applied.

By the structure resulting from the difference in halogen compositions, used herein, it is meant that the layered structure grain or the epitaxial grain described above has an interface region between portions having different halogen compositions. For example, one side of the interface region may be of silver iodide, while the other side may be of silver chloride, silver bromide, silver chlorobromide, silver iodobromide, or silver chlorobromoiodide. Alternatively, one side of the interface region may be of silver bromide or silver iodobromide, while the other side may be of silver chloride, silver bromide, silver chlorobromide, silver iodobromide, or silver chlorobromoiodide. Further, one side of the interface region may be of silver chloride or silver chlorobromide, while the other side may be of silver chloride, silver bromide, silver chlorobromide, silver iodobromide, or silver chlorobromoiodide. The interface region between portions having different halogen compositions have gradual difference in the silver iodide content preferably by 3 mol % or more, more preferably by 5 mol % or more, and most preferably by 10 mol % or more. In the case of the gradual difference in the silver bromide content, the gradual difference in the silver bromide content is preferably 5 mol % or more, more preferably 10 mol % or more. In the case of the gradual difference in the silver chloride content, the gradual difference in the silver chloride content is preferably 5 mol % or more, more preferably 10 mol % or more.

Preferable grains having the structure resulting from the difference in the halogen compositions are layered grains having a core or inner nucleus of high silver iodide content, and an outermost layer or outermost shell of low silver iodide content. In this case, both the inner nucleus and the outermost shell have a silver bromide content of preferably 60 mol % or more, and the difference in the silver iodide content between the inner nucleus and the outermost shell is preferably 5 mol % or more, more preferably 10 mol % or more, and most preferably 20 mol % or more. The grains having a distinct layered structure disclosed in JP-A-60-143331 are preferred. Other preferable grains having a layered structure are those having an outermost shell of a silver iodide content higher than the core and are disclosed in U.S. Pat. No. 4,433,048. In the case of this type of grains, the outermost shell has a silver iodide content higher than the core by 3 mol % or more, preferably 5 mol % or more, most preferably 10 mol % or more. Another preferable type of layered grains having a core of high silver bromide content, and an outermost shell of a high silver chloride content and is disclosed in JP-A-61-215540.

Preferable combinations of halogen compositions in epitaxial structure grains are disclosed in U.S. Pat. Nos. 4,094,684, 4,142,900, 4,435,501, and 4,463,087.

The oxidizing agent for silver used in the present invention is a compound which acts on metal silver and converts it into silver ions. The most useful is a compound which can convert the very fine particles of silver atoms generated during the forming of silver halide grains, into silver ions. The silver ions thus generated may form a silver salt which is hardly soluble in water, e.g., silver halide, silver sulfide, silver selenide, or may form a silver salt which is readily soluble in water, e.g. silver nitride.

The oxidizing agent for silver can either be organic or inorganic in nature. Examples of the inorganic adduct thereof (e.g., $NaBO_2.H_2O_2.3H_2O$, $2NaCO_3.3H_2O_2$, $NaO_4P_2O.2H_2O_2$, $2Na_2SO_4.H_2O_2.2H_2O$), a salt of peroxy acid (e.g., $K_2S_2O_8$, $K_2C_2O_6$, $K_2P_2O_8$), a peroxy complex compound (e.g., $K_2[Ti(O_2)C_2O_4]3H_2O$, $4K_2SO_4.Ti(O_2)OH.SO_4.2H_2O$, $Na_3[VO(O_2)(C_2O_4)_2.6H_2O$), a salt of oxygen acid such as permanganate (e.g., $KMnO_4$), chromate (e.g., $K_2Cr_2O_7$), halogen such as iodine or bromine, perhalogenate (e.g., potassium periodate), a salt of high-valence metals (e.g., potassium hexacyano ferric acid), and thiosulfonates.

Examples of the organic oxidizing agent are a quinone such as p-quinone, an organic peroxide such as peracetic acid and perbenzoic acid, a compound releasing activated halogen (e.g., N-bromo succinimide, chloramine T, and chloramine B).

Of the inorganic oxidizing agents specified above, ozone, hydrogen peroxide, its adduct, halogen, and thiosulfonate are preferable in the present invention. Of the organic oxidizing agents specified above, quinones, are preferable in the present invention.

A more preferable oxidizing agent for silver is a thiosulfonate selected from the group consisting of the compounds represented by formulas [I] to [III]. Of these compounds, the most preferable is the compound of formula [I].

S. Gahler reported in Veroff wiss. Photoab Wolfen X, 63 (1965) that thiosulfonic acid oxidizes silver, thereby forming silver sulfide in the manner represented by the following reaction formula:

$$RSO_2SM + 2Ag \rightarrow RSO_2M + Ag_2S$$

This specific oxidation has been experimentally proved to take place.

$$R-SO_2S-M \quad (I)$$

$$R-SO_2S-R^1 \quad (II)$$

$$RSO_2S-Lm-SSO_2-R^2 \quad (III)$$

where R, $R^1$, and $R^2$ are either the same or different and represent an aliphatic group, an aromatic group, or a heterocyclic group, M represents a cation, L represents a divalent linking group, and m is 0 or 1. It should be noted that polymers having as a repeating unit a divalent group derived from the compounds of formula [I], [II] or [III] can be used instead of the compounds of formula [I], [II] or [III]. It is also possible to use, as an oxidizing agent, the compounds of formula [I], [II] [III] in which R, $R^1$, $R^2$ and L are combined together to form a ring.

Thiosulfonic acid compounds represented by formulas [I] to [III] will be explained in greater detail. When R, $R^1$, and $R^2$ each represent an aliphatic group, it is a saturated or unsaturated, straight-chain, branched or cyclic aliphatic hydrocarbon group and is preferably an alkyl group having 1 to 22 carbon atoms or an alkenyl or alkynyl group having 2 to 22 carbon atoms. These groups can be a substituted. Examples of the alkyl group are methyl, ethyl, prophyl, butyl, pentyl, hexyl, octyl, 2-ethylhexyl, decyl, dodecyl, hexadecyl, octadecyl, cyclohexyl, isopropyl, and t-butyl. Examples of the alkenyl group are allyl and butenyl. Examples of the alkynyl group are propargyl and butynyl.

When R, $R^1$, and $R^2$ each represent an aromatic group, it is an aromatic group of monocyclic or condensed-ring, preferably one having 6 to 20 carbon atoms. Examples of the aromatic group are phenyl and naphthyl. These groups may be substituted.

When R, $R^1$, and $R^2$ each represent a heterocyclic group, it is a 3- to 15-membered ring, preferably 3- to 6-membered ring, having at least one element selected from nitrogen, oxygen, sulfur, selenium, and tellurium and at least one carbon. Examples of the heterocyclic group are a pyrrolidine ring a piperidine ring, pyridine ring, a tetrahydrofurane ring, a thiophene ring, a oxazole ring, a thiazole ring, a imidazole ring, a benzothiazole ring, a benzoxazole ring, a henzimidazole ring, a selenazole ring, a benzoselenazole ring, a tellurazole ring, a triazole ring, a benzotriazole ring, a terazole ring, a oxadiazole ring, and a thiadiazole ring.

Examples of the substituent on R, $R^1$, and $R^2$ are an alkyl group (e.g., methyl, ethyl, and hexyl), an alkoxy group (e.g., methoxy, ethoxy, and octyloxy), an aryl group (e.g., phenyl, naphthyl, and tolyl), a hydroxyl group, a halogen atom (e.g., fluorine, chlorine, bromine, and iodine), an aryloxy group (e.g., phenoxy), an alkylthio group (e.g., methylthio and butylthio), an arylthio group (e.g., phenylthio), an acyl group (e.g., acetyl, propionyl, butyryl, and valeryl), a sulfonyl group (e.g., methyl sulfonyl and phenylsulfonyl), an acrylamino group (e.g., acetylamino and benzoylamino), a sulfonylamino group (e.g., methanesulfonylamino and benzenesulfonylamino), an acyloxy group (e.g., acetoxy and benzoxy), a carboxyl group, a cyano group, a sulfo group, an amino group, $-SO_2SM$ (M is a monovalent cation), and $-SO_2R^1$.

The divalent linking group represented by L is an atom or an atom group containing at least one of C, N, S, and O. Examples of the divalent linking group L are an alkylene group, an alkenylene group, an alkynylene group, an arylene group, —O—, —S—, —NH—, —CO—, $-SO_2-$. These divalent groups can be used either singly or in combination of two or more of them. Preferably, L is a divalent aliphatic group or a divalent aromatic group. Examples of the divalent aliphatic group L are $-(CH_2)_n-$ (n is 1 to 12), $-CH_2-CH=CH-CH_2-$, $-CH_2C\equiv CCH_2-$,

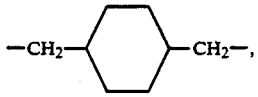

and xylylene group. Examples of the divalent aromatic group L are a phenylene group and a naphtylene group.

These substituent can be substituted by the substituent specified above.

M is preferably a metal ion, or an organic cation. Examples of the metal ion are a lithium ion, a sodium ion, and a potassium ion. Examples of the organic cation are an organic ammonium ion (e.g., tetramethylammonium, and tetrabutylammonium), an organic phosphonium ion (e.g., tetraphenylphosphonium), and a gaunidil group.

When the oxidizing agent used in the present invention is one of polymers having as a repeating unit a divalent group derived from the compounds of formula [I], [II], or [III], the examples of the repeating unit are as follows:

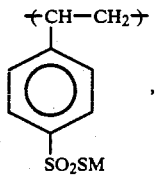

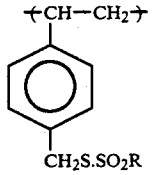

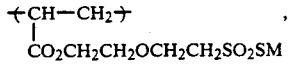

-continued

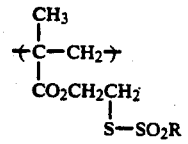

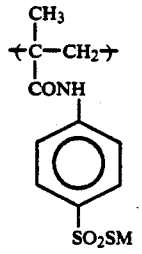

Each of the polymers mentioned above can be a homopolymer or a copolymer with another copolymerizable monomer.

Examples of the compounds represented by formulas [I] to [III] and polymers having as a repeating unit a divalent group derived from the formula [I], [II], or [III] are listed in Table A below. However, the compounds are not limited to those shown in Table A. The compounds of formulas [I] to [III] can easily be synthesized by the methods described in JP-A-54-1019, British Patent 972,211, and *Journal of Organic Chemistry,* Vol. 53, p. 396, 1988.

It is desirable that the oxidizing agent be added in an amount of $10^{-7}$ to $10^{-1}$ mol per mol of silver. Preferably, the amount is $10^{-6}$ to $10^{-2}$ mol per mol of silver. More preferably, the amount is $10^{-5}$ to $10^{-3}$ mol per mol of silver. It is desirable that the oxidizing agent be added while silver halide grains are being formed. After the forming of the grains is completed, the silver halide grains are chemically sensitized by means of desalination or re-dispersion. If the oxidizing agent is added during, or after the chemical sensitization, the expected results cannot be obtained. Preferably, the oxidizing agent is added before or during the forming of the grains each having portions of different halogen compositions.

In order to add the oxidizing agent represented by formulas [I] to [III] during the forming of silver halide grains, the common method of applying additives to photographic emulsions can be employed. More specifically, if the oxidizing agent is a water-soluble compound, it is dissolved in water, thus preparing an aqueous solution of an appropriate concentration. Alternatively, if the oxidizing agent is a compound which can hardly be dissolved in water, it is dissolved in a proper organic solvent which may be miscible with water, such as alcohols, glycols, ketones, esters, amides, which do not affect the photographing properties of the emulsion, thereby preparing a solution having an appropriate concentration. Then, the solution, thus prepared, is added to the emulsion.

The silver halide grains in the emulsion according to the invention are made of either silver iodobromide or silver iodochlorobromide containing, on average, 1 to 30 mol % of silver iodide. Preferably, they contain 7 to 20 mol % of silver iodide. When they are made of silver iodochlorbromide, they can contain 10 mol % or less of silver chloride.

A silver halide grain which can be used in the silver halide emulsion of the present invention can be selected from a regular crystal not including a twined crystal plane and a twined crystal described in Japan Photographic Society ed., "Silver Salt Photographs, Basis of Photographic Industries", (Corona Co., P. 163) such as a single twined crystal including one twined crystal face, a parallel multiple twined crystal including two or more parallel twined crystal faces, and a non-parallel multiple twined crystal including two or more non-parallel twined crystal faces, in accordance with its application. In the case of a regular crystal, a cubic grain comprising (100) faces, an octahedral grain comprising (111) faces, and a dodecahedral grain comprising (110) faces disclosed in JP-B-55-42737 and JP-A-60-222842 can be used. In addition, a grain comprising (h11), e.g., (211) faces, a grain comprising (hh1), e.g., (331) faces, a grain comprising (hk0), e.g., (210) faces, and a grain comprising (hk1), e.g., (321) faces as reported in "Journal of Imaging Science", Vol. 30, P. 247, 1986 can be selectively used in accordance with an application although a preparation method must be improved. A grain including two or more types of faces, e.g., a tetradecahedra grain comprising both (100) and (111) faces, a grain comprising both (100) and (110) faces, and a grain comprising both (111) and (110) faces can be selectively used in accordance with an application.

The silver halide grains ma be fine grains having a grain size of 0.1 μm or less or large grains having a projected surface area diameter of 10 μm.

The present invention can be advantageous, whether it is applied to a monodisperse silver halide emulsion or a polydisperse silver halide emulsion. Preferably, the invention is applied to a monodisperse silver halide emulsion. The word "monodisperse" means that the variation coefficient of the silver halide grains, in terms of volume or sphere-equivalent diameter, or both, is 25% or less. The variation coefficient of the silver halide grains is preferably 20% or less, more preferably 15% or less.

The photographic emulsions for use in the present invention can be prepared using the methods described in, for example, P. Glafkides, "Chimie et Physique Photographique", Paul Montel, 1967; Duffin, "Photographic Emulsion Chemistry", Focal Press, 1966; and V. L. Zelikman et al., "Making and Coating the photographic emulsion", Focal Press, 1964. The described method may be, for example, an acid method, a neutralization method, and an ammonia method. Also, as a system for reacting a soluble silver salt and a soluble halide, the single jet method, the double-jet method, or a combination thereof can be used. Also, a so-called reverse mixing method for forming silver halide grains in the presence of excessive silver ions can be used. As one system of the double-jet method, a so-called controlled double-jet method, wherein the pAg in the liquid phase in which the silver halide is generated is kept at a constant value can be used. According to this method, a silver halide emulsion having a regular crystal form and almost uniform grain sizes is obtained.

A silver halide emulsion containing the regular grains described above can be obtained by controlling pAg and pH during the process of forming the grains. The method of controlling pAg and pH is detailed in, for example, *Photographic Science and Engineering,* Vol. 6, pp. 159–165, 1962, *Journal of Photographic Science,* Vol. 12, pp. 242–251, 1964, U.S. Pat. No. 3,655,394, and British Patent 1,413,748.

A tabular grain having an aspect ratio of 3 or more can also be preferably used in the present invention. The tabular grain can be easily prepared by methods described in, for example, Cleve, "Photography Theory and Practice", P. 131, (1930); Gutoff, "Photographic Science and Engineering", Vol. 14, PP. 248 to 257, (1970); and U.S. Pat. Nos. 4,434,226, 4,414,310, 4,433,048 and 4,439,520 and British Patent 2,112,157. When the tabular grain is used, covering power and a color sensitizing efficiency of a sensitizing dye can be advantageously improved. These advantages are described in detail in the U.S. Pat. No. 4,434,226.

It is preferable that the emulsion according to the invention contains tabular grains. Tabular grains, in which grains having an aspect ratio of 3 or more occupies 60% or more of the total projected surface area, are preferable in particular. More preferably are tabular grains in which those having an aspect ratio of 3 to 10 occupies 60% or more of the total projected surface area. Also, it is preferable that the tabular grains have a monodisperse distribution. In other words, it is desirable that sizes of the tabular grains have a variation coefficient of 25% or less, preferably 20% or less, or more preferably 15% or less, in terms of circle-equivalent diameter of projection area or sphere-equivalent diameter of volume.

The silver halide emulsion for use in the present invention can be subjected to a treatment for rounding a grain as disclosed in, e.g., EP-0096727B1 and EP-0064412B1 or a treatment of modifying the surface of a grain as disclosed in DE-2306447C2 and JP-A-60-221320.

The silver halide emulsion according to the present invention is preferably used as a surface latent image type. It can be also used, however, as an internal latent image type emulsion by selecting a developing solution or development conditions as disclosed in JP-A-59-133542. In addition, a shallow internal latent image type emulsion covered with a thin shell can be effective in accordance with an application.

A solvent for silver halide can be effectively used to promote ripening. For example, in a known conventional method, an excessive amount of halogen ions are supplied in a reaction vessel in order to promote ripening. Therefore, it is apparent that ripening can be promoted by only supplying a halide solution into a reaction vessel. In addition, other ripening agents can be used. In this case, a total amount of these other ripening agents can be mixed in a dispersion medium in the reaction vessel before a silver salt and a halide are added therein, or they can be added in the reaction vessel together with one or more halides, a silver salt or a deflocculant. Alternatively, the ripening agents can be added independently in the step of adding a halide and a silver salt.

Examples of the ripening agent other than the halogen ion are ammonium, an amine compound and a thiocyanate such as an alkali metal thiocyanate (especially sodium thiocyanate or potassium thiocyanate), and ammonium thiocyanate.

In the present invention, the silver halide grains are subjected to at least one of, sulfur sensitization, gold sensitization, or noble metal sensitization in an arbitrary step of silver halide emulsion manufacturing steps, or typically, a grain formation step.

A portion at which the chemical sensitization is performed differs depending on the composition, structure, or shape of an emulsion grain or an application of the emulsion. A chemical sensitization nucleus is embedded either inside a grain or in a shallow portion from the grain surface or formed on the surface of a grain. Although the present invention is effective in any case, the chemical sensitization nucleus is most preferably formed in a portion near the surface. That is, the present invention is more effective in the surface latent image type emulsion than in the internal latent image type emulsion.

As chemical sensitization which can be preferably performed in the present invention, gold sensitization, sulfur sensitization, and noble sensitization can be performed singly or in a combination of two or more thereof.

The chemical sensitization can be performed by using active gelatin as described in T. H. James, "The Theory of the Photographic Process", 4th ed., Macmillan, 1977, PP. 67 to 76. Alternatively, the chemical sensitization can be performed at a pAg of 5 to 10, a pH of 5 to 8 and a temperature of 30° to 80° C. by using sulfur, selenium, tellurium, gold, platinum, palladium or irridium, or a combination of a plurality of these sensitizers as described in Research Disclosure (to be referred to as simply "RD." hereinafter) Vol. 120, No. 12,008 (April, 1974), RD. Vol. 34, No. 13,452 (June, 1975), U.S. Pat. Nos. 2,642,361, 3,297,446, 3,772,031, 3,857,711, 3,901,714, 4,266,018, and 3,904,415, and British Patent 1,315,755. The chemical sensitization is optimally performed in the presence of a gold compound and a thiocyanate compound, a sulfur-containing compound described in U.S. Pat. Nos. 3,857,711, 4,266,018 and 4,054,457 or a sulfur-containing compound such as a hypo, thiourea compound and a rhodanine compound. Chemical sensitization can also be performed in the presence of a chemical sensitization assistant. An example of the chemical sensitization assistant is a compound known to suppress fogging and increase sensitivity in the chemical sensitization process such as azaindene, azapyridazine, and azapyrimidine. Examples of a chemical sensitization assistant modifier are described in U.S. Pat. Nos. 2,131,038, 3,411,914, 3,554,757, JP-A-58-126526, and G. F. Duffin, *Photographic Emulsion Chemistry*, pp. 138–143.

The emulsion according to the invention will exhibit desirable properties if the grains are gold-sensitized, too. A gold-sensitizer should applied in an amount of, preferably, $1\times10^{-4}$ to $1\times10^{-7}$ mol per mol of silver halide, more preferably $1\times10^{-5}$ to $5\times10^{-7}$ mol per mol of silver halide.

The amount in which a sulfur sensitizer should be applied to the silver halide grains according to the present invention is preferably $1\times10^{-4}$ to $1\times10^{-7}$ mol per mol of silver halide, and more preferably $1\times10^{-5}$ *to* $5\times10^{-7}$ mol per mol of silver halide.

It is desirable that gold-sulfur sensitization be carried out under the above-mentioned conditions.

Further, it is desirable that the silver halide grains of the present invention be also subjected to reduction sensitization, during the forming of the grains, before or during the chemical sensitization after the grains have been completely formed, or after the chemical sensitization. The reduction sensitization is one of the following three methods or any combination of these methods.

1. A method wherein a reduction sensitizer is added to the silver halide emulsion.

2. A method, generally known as "silver ripening," wherein grains are grown or ripened in a low-pAg atmosphere of pAg 1 to 7.

3. A method, generally known as "high-pH ripening," wherein grains are grown or repined in a high pH atmosphere of pH 8 to 11.

Of the methods specified above, the method 1 is preferred since it is possible to adjust minutely the level of the reduction sensitization.

Known as reduction sensitizer are stannous salt, ascorbic acid, a derivative of ascorbic acid, amine and polyamine, hydrazine derivative, formamidinsulfiric acid, a silane compound, and a borane compound. In the reduction sensitization of the present invention, these known reduction sensitizers can be used, either singly or in combination. Preferable as reduction sensitizer for use in the present invention are stannous chloride, thiourea dioxide, dimethylamineborane, ascorbic acid and derivatives thereof. Although an addition amount of these reduction sensitizer need to be selected in accordance with the conditions under which the emulsion is manufactured, the appropriate amount ranges from $10^{-7}$ to $10^{-3}$ mol per mol of silver halide.

Any reduction sensitizer used is dissolved in a solvent such as alcohol, glycol, ketone, ester, or amide, thus preparing a solution. The solution is added to the emulsion during the forming of the grains. The solution can be introduced into an reaction vessel before the grain-forming, but it is advisable to added it to the emulsion at a appropriate time during the grain-forming. Alternatively, the reduction sensitizer can first be added to an aqueous solution of either water-soluble silver salt or water-soluble alkali halide, and the sensitizer-containing aqueous solution can then be applied to the emulsion, thus precipitating the silver halide grains. Further, during grain-growing up, a solution of the reduction sensitizer can be added several times, portion by portion, to the emulsion, or can be added continuously at a small rate over a long period of time.

The photographic emulsion for use in the present invention can contain various compounds in order to prevent fogging during manufacture, storage, or a photographic process of the light-sensitive material or to stabilize photographic properties of the light-sensitive material. Examples of the compound known as an antifoggant or stabilizer are azole, e.g., benzothiazolium salt, nitroimidazole, nitrobenzimidazole, chlorobenzimidazole, bromobenzimidazole, mercaptothiazole, mercaptobenzothiazole, mercaptobenzimidazole, mercaptothiadiazole, aminotriazole, benzotriazole, nitrobenzotriazole, and mercaptotetrazole (especially, 1-phenyl-5-mercaptotetrazole); mercaptopyrimidine; mercaptotriadine; a thioketo compound e.g. oxadrinthione; azaindene, e.g., triazaindene, tetraazaindene (especially, 4-hydroxysubstituted(1,3,3a,7)tetraazaindene), and pentaazaindene. Examples are described in U.S. Pat. Nos. 3,954,474 and 3,982,947 and JP-B-52-28660.

The photographic emulsion used in the present invention can be spectrally sensitized by, e.g., methine dyes. Examples of the dye used for this purpose are a cyanine dye, merocyanine dye, a composite cyanine dye, a composite merocyanine dye, a holopolar cyanine dye, a hemicyanine dye, a styryl dye, and a hemioxonol dye. Most effective dyes are those belonging to a cyanine dye, a merocyanine dye, and a composite merocyanine dye. In these dyes, any nucleus normally used as a basic heterocyclic nucleus in cyanine dyes can be applied. Examples of the nucleus are a pyrroline nucleus, an oxazoline nucleus, a thiozoline nucleus, a pyrrole nucleus, an oxazole nucleus, a thiazole nucleus, a selenazole nucleus, an imidazole nucleus, a tetrazole nucleus, and a pyridine nucleus; a nucleus obtained by condensation of an alicyclic hydrocarbon ring to each of the above nuclei; and a nucleus obtained by condensation of an aromatic hydrocarbon ring to each of the above nuclei, e.g., an indolenine nucleus, a benzindolenine nucleus, an indole nucleus, a benzoxadole nucleus, a naphthooxazole nucleus, a benzothiazole nucleus, a naphthothiazole nucleus, a benzoselenazole nucleus, a benzimidazole nucleus, and a quinoline nucleus. These nuclei can have a substituent group on a carbon atom.

As a merocyanine dye or composite merocyanine dye, a 5- or 6-membered heterocyclic nucleus e.g., a pyrazoline-5-one nucleus, a thiohydantoin nucleus, a 2-thiooxazolidine-2,4-dione nucleus, a thiazolidine-2,4-dione nucleus, a rhodanine nucleus, and a thiobarbituric acid nucleus can used as a nucleus having a ketomethylene structure.

These sensitizing dyes can be used singly or in a combination of two or more thereof. A combination of the sensitizing dyes is often used especially in order to perform supersensitization. Typical examples of the combination are described in U.S. Pat. Nos. 2,688,545, 2,977,229, 3,397,060, 3,522,052, 3,527,641, 3,617,293, 3,628,964, 3,666,480, 3,672,898, 3,679,428, 3,703,377, 3,769,301, 3,814,609, 3,837,862, 4,026,707, British Patents 1,344,281 and 1,507,803, JP-B-43-4936 and JP-B-53-12375, and JP-A-52-110618 and JP-A-52-109925.

The emulsion of the present invention can contain, in addition to the sensitizing dye, a dye not having a spectral sensitizing effect or a substance substantially not absorbing visible light and having supersensitization.

The sensitizing dye can be added in the emulsion at any timing conventionally known to be effective in emulsion preparation. Most ordinarily, the sensitizing dye is added after completion of chemical sensitization and before coating. However, the sensitizing dye can be added at the same time as a chemical sensitizer to simultaneously perform spectral sensitization at the same time as chemical sensitization as described in U.S. Pat. Nos. 3,628,969 and 4,225,666. The dye can also be added before chemical sensitization as described in JP-A-58-113928, or added before completion of silver halide grain precipitation to start spectral sensitization. In addition, as described in U.S. Pat. No. 4,225,666, a part of the above compound can be added before chemical sensitization and the remaining portion is added thereafter. Further, as described in U.S. Pat. No. 4,183,756, the compound can be added at any timing during silver halide grain formation.

An addition amount of the above sensitizing dye can be $4\times10^{-6}$ to $8\times10^{-3}$ mol per mol of a silver halide. When a silver halide grains has a more preferable size of 0.2 to 1.2 μm, an addition amount of about $5\times10^{-5}$ to $2\times10^{-3}$ mol is more effective.

The above various additives are used in the light-sensitive material of the present invention. In addition to the above additives, however, various additives can be used in accordance with applications.

These additives are described in greater detail in RD., Item 17643 (Dec. 1978) and Item 18716 (Nov. 1979) and they are summarized in the following table.

| Additives | RD No 17643 | RD No.18716 |
|---|---|---|
| 1. Chemical sensitizers | page 23 | page 648, right column |
| 2. Sensitivity increasing agents | | page 648, right column |

-continued

| Additives | RD No 17643 | RD No.18716 |
|---|---|---|
| 3. Spectral sensitizers, super sensitizers | pages 23–24 | page 648, right column to page 649, right column |
| 4. Brighteners | page 24 | |
| 5. Antifoggants and stabilizers | pages 24–25 | page 649, right column |
| 6. Light absorbent, filter dye, ultraviolet absorbents | pages 25–26 | page 649, right column to page 650, left column |
| 7. Stain preventing agents | page 25, right column | page 650, left to right columns |
| 8. Dye image stabilizer | page 25 | |
| 9. Hardening agents | page 26 | page 651, left column |
| 10. Binder | page 26 | page 651, left column |
| 11. Plasticizers, lubricants | page 27 | page 650, right column |
| 12. Coating assistant, surface active agents | pages 26–27 | page 650, right column |
| 13. Antistatic agents | page 27 | page 650, right column |

Preferably, the photographic light-sensitive material according to the invention is a silver halide color photographic light-sensitive material, and, in particular, one which is used in combination with a negative-type emulsion.

In this invention, various color couplers can be used in the light-sensitive material. Specific examples of these couplers are described in above-described RD., No. 17643, VII-C to G as patent references.

Preferred examples of a yellow coupler are described in, e.g., U.S. Pat. Nos. 3,933,501, 4,022,620, 4,326,024, and 4,401,752, JP-B-58-10739, and British Patents 1,425,020 and 1,476,760.

Preferred examples of a magenta coupler are 5-pyrazolone and pyrazoloazole compounds. Most preferable examples of the compounds are described in, e.g., U.S. Pat. Nos. 4,310,619 and 4,351,897, EP 73,636, U.S. Pat. Nos. 3,061,432 and 3,752,067, RD. No. 24220 (June 1984), JP-A-60-33552, Research Disclosure No. 24230 (June 1984), JP-A-60-43659, and U.S. Pat. Nos. 4,500,630 and 4,540,654.

Examples of a cyan coupler are phenol and naphthol couplers. Preferable examples of the coupler are described in, e.g., U.S. Pat. Nos. 4,052,212, 4,146,396, 4,228,233, 4,296,200, 2,369,929, 2,801,171, 2,772,162, 2,895,826, 3,772,002, 3,758,308, 4,334,011, and 4,327,173, West German Patent Disclosure Gazette (OLS) No. 3,329,729, EP 121,365A, U.S. Pat. Nos. 3,446,622, 4,333,999, 4,451,559, and 4,427,767, and EP 161,626A.

Preferable examples of a colored coupler for correcting additional, undesirable absorption of colored dye are those described in RD. No. 17643, VII-G, U.S. Pat. No. 4,163,670, JP-B-57-39413, U.S. Pat. Nos. 4,004,929 and 4,138,258, and British Patent 1,146,368.

Preferable examples of a coupler capable of forming colored dyes having proper diffusibility are those described in U.S. Pat. No. 4,366,237, British Patent 2,125,570, EP 96,570, and West German Patent Application (OLS) No. 3,234,533.

Typical examples of a polymerized dye-forming coupler are described in U.S. Pat. Nos. 3,451,820, 4,080,211, and 4,367,282, and British Patent 2,102,173.

Couplers releasing a photographically useful residue upon coupling are also preferably used in the present invention. Preferable DIR couplers, i.e., couplers releasing a development inhibitor are described in the patents cited in the above-described RD. No. 17643, VII-F, JP-A-57-151944, JP-A-57-154234, JP-A-60-184243, and U.S. Pat. No. 4,248,962.

Preferable examples of a coupler imagewise releasing a nucleating agent or a development accelerator upon development are those described in British Patent 2,097,140, 2,131,188, and JP-A-59-157638 and JP-A-59-170840.

Other examples of a coupler which can be used in the light-sensitive material of the present invention are competing couplers described in, e.g., U.S. Pat. No. 4,130,427; poly-equivalent couplers described in, e.g., U.S. Pat. Nos. 4,283,472, 4,338,393, and 4,310,618; DIR redox compound, a DIR coupler, a DIR coupler releasing coupler, and a DIR coupler releasing redox compound described in, e.g., JP-A-60-185950 and JP-A-62-24252; a coupler releasing a dye which turns to a colored form after being released described in European Patent No. 173,302A; bleaching accelerator releasing couplers described in, e.g., R.D. Nos. 11449 and 24241 and JP-A-61-201247; and a ligand releasing coupler described in, e.g., U.S. Pat. No. 4,553,477.

The couplers for use in this invention can be introduced in the light-sensitive materials by various known dispersion methods.

Examples of a high-boiling solvent used in an oil-in-water dispersion method are described in, e.g., U.S. Pat. No. 2,322,027.

Examples of a high-boiling organic solvent to be used in the oil-in-water dispersion method and having a boiling point of 175° C. or more at normal pressure are phthalic ester (e.g., dibutylphthalate, dicyclohexylphthalate, di-2-ethylhexylphthalate); ester of phosphoric acid or phosphonic acid (e.g., triphenylphosphate, tricresylphosphate, 2-ethylhexyldiphenylphosphate, tricyclohexylphosphate, tri-2-ethylhexylphosphate); ester of benzoic acid (e.g., 2-ethylhexylbenzoate, dodecylbenzoate, and 2-ethylhexyl-p-hydroxybenzoate); amide (e.g., N,N-diethyldodecaneamide, N,N-diethyllaurylamide, and N-tetradecylpyrrolidone); alcohol or phenol (e.g., isostearylalcohol and 2,4-di-tert-amylphenol); ester of aliphatic carboxylic acid (e.g., bis(2-ethylhexyl)sebacate, dioctylazelate, glyceroltributylate, isostearyllactate, and trioctylcitrate); an aniline derivative (e.g., N,N-dibutyl-2-butoxy-5-tert-octylaniline); and hydrocarbon (e.g., paraffin, dodecylbenzene, and diisopropylnaphthalene). An organic solvent having a boiling point of about 30° C. or more, and preferably, 50° C. to about 160° C. can be used as an auxiliary solvent. Typical examples of the auxili solvent are ethyl acetate, butyl acetate, ethyl propionate, methylethylketone, cyclohexanone, 2-ethoxyethylacetate, and dimethylformamide.

Steps and effects of a latex dispersion method and examples of an loadable latex are described in e.g. U.S. Pat. No. 4,199,363, West German Patent Application (OLS) Nos. 2,541,274 and 2,541,230.

The present invention can be applied to various color light-sensitive materials. Typical examples of the color light-sensitive material are a color negative film for a general purpose or a movie, a color reversal film for a slide or a television, color paper, a color positive film, and color reversal paper.

When the light-sensitive material according to the present invention is used as a material for color photographing, the present invention can be applied to light-sensitive materials having various structures and to light-sensitive materials having combinations of various layer structures and special color materials.

Typical examples are: light-sensitive materials, in which a coupling speed and diffusibility of a color coupler is combined with a layer structure, as disclosed in, e.g., JP-B-47-49031, JP-B-49-3843, JP-B-50-21248, JP-A-59-38147, JP-A-59-60437, JP-A-60-227256, JP-A-61-4043, JP-A-61-43743, and JP-A-61-42657; light sensitive materials, in which a same-color-sensitive layer is divided into two or more layers, as disclosed in JP-B-49-15495 and U.S. Pat. No. 3,843,469; and light-sensitive materials, in which an arrangement of high- and low-sensitivity layers or an arrangement of layers having different color sensitivities is defined, as disclosed in JP-B-53-37017, JP-B-53-37018, JP-A-51-49027, JP-A-52-143016, JP-A-53-97424, JP-A-53-97831, JP-A-62-200350, and JP-A-59-177551.

Examples of a support suitable for use in this invention are described, for example, in the above-mentioned RD. No. 17643, page 28 and ibid., No. 18716, page 647, right column to page 648, left column.

The color photographic light-sensitive materials of this invention can be processed for development by the ordinary processes as described, for example, in above-described RD., No. 17643, pages 28 to 29 and ibid., No. 18716, page 651, left column to right column.

A color developer used in developing of the light-sensitive material of the present invention is, preferably, an aqueous alkaline solution containing, as a main component, color developing agent of an aromatic primary amine-series. As the color developing agent, an aminophenol-series compound is effective. In addition, a p-phenylenediamine-series compound is preferably used. Typical examples of the p-phenylenediamine-series compound are 3-methyl-4-amino-N,N-diethylaniline, 3-methyl-4-amino-N-ethyl-N-β-hydroxyethylaniline, 3-methyl-4-amino-N-ethyl-N-β-methanesulfonamidoethylaniline, 3-methyl-4-amino-N-ethyl-N-β-methoxyethylaniline, and sulfates, hydrochlorides and p-toluenesulfonates thereof. These compounds can be used in a combination of two or more thereof in accordance with applications.

In general, the color developer contains a pH buffering agent such as a carbonate, a borate or a phosphate of an alkali metal, and a development restrainer or antifoggant such as a bromide, an iodide, a benzimidazole, a benzothiazole or a mercapto compound. If necessary, the color developer solution can also contain a preservative such as hydroxylamine, diethylhydroxylamine, a hydrazine sulfite, a phenylsemicarbazide, triethanolamine, a catechol sulfonic acid or a triethylenediamine(1,4-diazabicyclo[2,2,2]octane); an organic solvent such as ethyleneglycol or diethyleneglycol; a development accelerator such as benzylalcohol, polyethyleneglycol, a quaternary ammonium salt or an amine; a dye-forming coupler; a competing coupler; a fogging agent such as sodium boron hydride; an auxiliary developing agent such as 1-phenyl-3-pyrazolidone; a viscosity imparting agent; and a chelating agent such as an aminopolycarboxylic acid, an aminopolyphosphonic acid, an alkylphosphonic acid or a phosphonocarboxylic acid. Examples of the chelating agent are ethylenediaminetetraacetic acid, nitrilotriacetic acid, diethylenetriaminepentaacetic acid, cyclohexanediaminetetraacetic acid, hydroxyethyliminodiacetic acid, 1-hydroxyethylidene-1,1-diphosphonic acid, nitrilo N,N,N-trimethylenephosphonic acid, ethylenediamine-N,N,N'N'-tetramethylenephosphonic acid and ethylenediamine-di(o-hydroxyphenylacetic acid), and salts thereof.

In order to perform reversal development, generally, black-and-white development is performed and then color development is performed. As a black-and-white developer, well-known black-and-white developing agents, e.g., a dihydroxybenzene such as hydroquinone, a 3-pyrazolidone such as 1-phenyl-3 pyrazolidone, and an aminophenol such as N-methyl-p-aminophenol can be used singly or in a combination of two or more thereof.

The pH of the color developer and the black-and-white developer is generally 9 to 12. Although a replenishment amount of the developer depends on a color photographic light-sensitive material to be processed for development, it is generally 3 liters or less per $m^2$ of the light-sensitive material. The replenishment amount can be decreased to be 500 ml or less by decreasing a bromide ion concentration in a replenishing solution. In the case of decreasing the replenishment amount, a contact area of the developer in a processing tank with air is preferably decreased in order to prevent evaporation and oxidation of the developer. The replenishment amount can be also decreased by using a means capable of suppressing an accumulation amount of bromide ions in the developer.

A color development time is normally set between 2 to 5 minutes. The processing time, however, can be shortened by setting a high temperature and a high pH of the developer and using the color developing agent at a high concentration.

The photographic emulsion layer is generally subjected to bleaching after color development. The bleaching can be performed either simultaneously with fixing (bleach-fixing) or independently thereof. In addition, in order to increase a processing speed, bleach-fixing can be performed after bleaching. Also, the processing can be performed in a bleach-fixing bath having two continuous tanks, wherein fixing can be performed before bleach-fixing, or bleaching can be performed after bleach-fixing, in accordance with applications. Examples of the bleaching agent are a compound of a multivalent metal such as iron (III), cobalt (III), chromium (VI) and copper (II); a peroxide; a quinone; a nitro compound. Typical examples of the bleaching agent are a ferricyanide; a dichromate; an organic complex salt of iron (III) or cobalt (III), e.g., a complex salt of iron (III) or cobalt (II) with an aminopolycarboxylic acid such as ethylenediaminetetraacetic acid, diethylenetriaminepentaacetic acid, cyclohexanediaminetetraacetic acid, methyliminodiacetic acid, 1,3-diaminopropanetetraacetic acid, and glycoletherdiaminetetraacetic acid, or a complex salt with citric acid, tartaric acid or malic acid; a persulfate; a bromate; a permanganate; and a nitrobenzene. Of these compounds, an iron (III) complex salt with aminopolycarboxylic acid such as an iron (III) complex salt with ethylenediaminetetraacetic acid, and a persulfate are preferred because they can increase a processing speed and prevent an environmental contamination. Especially, the iron (III) complex salt with aminopolycarboxylic acid is effective in both the bleaching solution and bleach-fixing solution. The pH of the bleaching solution or the bleach-fixing solution using the iron (III) complex salt with aminopolycarboxylic acid is normally 5.5 to 8. In order to increase the processing speed, however, processing can be performed at a lower pH.

A bleaching accelerator can be used in the beaching solution, the bleach-fixing solution, and their pre-bath, if necessary. Examples of effective bleaching accelerators are disclosed in U.S. Pat. No. 3,893,858. The compounds described in U.S. Pat. No. 4,552,834 are preferable, too. These bleaching accelerators can be added to the light-sensitive material. They are effective especially in bleach-fixing of a color light-sensitive material for photographing purposes.

Examples of the fixing agent are a thiosulfate, a thiocyanate, a thioether-series compound, a thiourea and a large amount of an iodide. Of these compounds, a thiosulfate, especially, ammonium thiosulfate can be used in a widest range of applications. As a preservative of the bleach-fixing solution, a sulfite, a bisulfite or a carbonyl bisulfite adduct is preferred.

The silver halide color photographic light-sensitive material of the present invention is normally subjected to washing with water and/or stabilizing steps after desilvering. An amount of water used in the washing step can be arbitrarily determined over a broad range depending on the properties of the light-sensitive material (e.g., a property determined by used substance such as a coupler), the application of the material, the temperature of the water, the number of water tanks (the number of stages), a replenishing scheme representing a counter or forward current, and other conditions. The relationship between the amount of water and the number of water tanks in a multi-stage counter-current scheme can be obtained by a method described in "Journal of the Society of Motion Picture and Television Engineers", Vol. 64, PP. 248-253 (May, 1955).

According to the above-described multi-stage counter-current scheme, the amount of water used for washing can be greatly decreased. Since washing water stays in the tanks for a long period of time, however, bacteria proliferate and floating substances produced by the bacteria can be undesirably attached to the light-sensitive material. In order to solve this problem in the process of the color photographic light-sensitive material of the present invention, a method of decreasing calcium and magnesium ions can be very effectively utilized, as described in JP-A-62-288838. In addition, a germicide such as an isothiazolone compound and thiabendazole described in JP-A-57-8542, a germicide of chlorine-series such as chlorinated sodium isocyanurate, and germicides such as benzotriazole described in Hiroshi Horiguchi, "Chemistry of Antibacterial and Antifungal Agents", Eiseigijutsu-Kai ed., "Sterilization, Antibacterial, and Antifungal Techniques for Microorganisms", and Nippon Bokin Bokabi Gakkai ed., "Cyclopedia of Antibacterial and Antifungal Agents" may be used.

The pH of the water for washing the photographic light-sensitive material of the present invention is 4 to 9, and preferably, 5 to 8. The water temperature and the washing time can vary in accordance with the properties and applications of the light-sensitive material. Normally, the washing time is 20 seconds to 10 minutes at a temperature of 15° to 45° C., and preferably, 30 seconds to 5 minutes at 25° to 40° C. The light-sensitive material of the present invention can be processed directly by a stabilizing solution in place of washing. All known methods described in JP-A-57-8543, JP-A-58-14834 and JP-A-60-220345 can be used in such stabilizing processing.

Further, stabilizing is sometimes performed subsequently to washing. An example thereof is the case in which a stabilizing bath containing formalin and a surface-active agent is used as a final bath of the color light-sensitive material for photographing. Various chelating agents and antifungal agents can be added also in the stabilizing bath.

An overflow liquid produced upon replenishment of the washing and/or stabilizing solution can be reused in another step such as a desilvering step.

The silver halide color light-sensitive material of the present invention can contain a color developing agent in order to simplify processing for development and increase the processing speed.

The silver halide color light-sensitive material of the present invention can contain various 1-phenyl-3-pyrazolidones in order to accelerate color development, if necessary. Typical examples of the compound are described in JP-A-56-64339, JP-A-57-144547 and JP-A-58-115438.

Each processing solution in the present invention is used at a temperature of 10° to 50° C. Although a normal solution temperature is 33° to 38° C., processing can be accelerated at a higher temperature to shorten a processing time, or quality of image and stability of a processing solution can be improved at a lower temperature. In order to save silver for the light-sensitive material, processing using cobalt intensification or hydrogen peroxide intensification described in West German Patent No. 2,226,770 or U.S. Pat. No. 3,674,499 can be performed.

The silver halide light-sensitive material of the present invention can also be applied to heat development light-sensitive materials described in, e.g., U.S. Pat. No. 4,500,626, JP-A-60-133449, JP-A-59-218443, JP-A-61-238056, and EP 210,660A2.

Although, present invention will be described in more detail below by way of its examples, the present invention is not limited to these examples.

EXAMPLE 1

Seed crystals A and B of silver iodobromide having a uniform halogen distribution structure of a silver iodide content of 6 mol % were prepared. The seed crystals A were octahedral regular grains having a sphere-equivalent diameter of 0.50 μm and a variation coefficient in the size distribution of about 14%. The seed crystals B were parallel twinned tabular grains having a sphere-equivalent diameter of 0.53 μm with a variation coefficient of 23%, and an average aspect ratio of 11.5.

Silver iodobromide containing 6 mol % of silver iodide was grown starting from the seed crystals A to obtain grains having a sphere-equivalent diameter of 1.4 μm, by means of controlled double jet method of flow rate-accelerated type, thereby preparing emulsion I. In a similar manner, silver iodobromide containing 30 mol % of silver iodide was grown starting from the seed crystals A to obtain grains having a sphere-equivalent diameter of 1.15 μm, and then silver bromide was grown on the resultant grains to obtain grains having a sphere-equivalent diameter of 1.4 μm, whereby emulsion II was prepared.

Silver iodobromide containing 30 mol % of silver iodide was grown starting from the seed crystals B to obtain grains having a sphere-equivalent diameter of 1.4 μm, by means of controlled double jet method of flow rate-accelerated type, thereby preparing emulsion III. The silver halide grains in emulsion III had a variation coefficient in the size distribution of 19% and an average aspect ratio of 7.5. In a similar manner, silver iodobromide containing 30 mol % of silver iodide was grown starting from the seed crystals B to obtain grains having a sphere-equivalent diameter of 1.15 μm, and then silver bromide was grown on the resultant grains to obtain grains having a sphere-equivalent diameter of 1.4 μm with silver bromide, thereby preparing emulsion IV. The silver halide grains in the emulsion IV had a variation coefficient in the size distribution of 18% and an average aspect ratio of 7.0. Further, homogeneous silver iodobromide grains containing 6 mol % of silver iodide, having a sphere-equivalent diameter of 1.35 μm, were prepared by the same method as the emulsion III. Then, a thin layer of silver iodobromide containing 20 mol % of silver iodide was formed on each grain, and an aqueous solution of silver nitrate and potassium chloride was added with the silver potential so selected as to epitaxially growing silver chloride at the corners of each tabular grain. The epitaxial growth of silver chloride at the corner was observed though an electron microscope. The emulsion thus obtained is referred to as emulsion V.

In preparing the emulsions I to V, using the seed crystals A or B, a thiosulfonic acid compound 1-2, 1-6 or 1-16, or hydrogen peroxide was added as an oxidizing agent for silver in an amount of $6.0\times10^{-5}$ mol per mol of silver. All emulsions I to V were subjected to normal desalting/washing process and redispersed at a temperature of 40° C., at pAG of 8.9 and pH of 6.3.

The emulsions I to V were chemically sensitized optimally, with sodium thiosulfate and chloroauric acid used in an amount of $6\times10^{-6}$ mol per mol of silver and $2\times10^{-6}$ mol per mol of silver, respectively.

A layer of emulsions I to V and a protective layer were coated on triacetylcelluose film supports each having an undercoating layer, in the amounts specified in Table 1, thereby preparing samples 1 to 13.

TABLE 1

| | |
|---|---|
| (1) Emulsion Layer | |
| Emulsion | emultions listed in Table 2. (silver $1.7\times10^{-2}$ mol/m$^2$) |
| Coupler | ($1.5\times10^{-3}$ mol/m$^2$) |

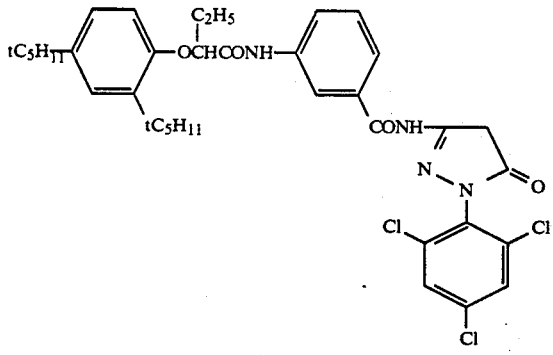

| | |
|---|---|
| Tricresylphosphate | (1.10 g/m$^2$) |
| Gelatin | (2.30 g/m$^2$) |
| (2) Protective Layer | |
| 2,4-dichlorotriazine-6-hydroxy-s-triazine sodium salt | (0.08 g/m$^2$) |
| Gelatin | (1.80 g/m$^2$) |

These samples 1 to 13 were subjected to sensitometry exposure, then performing the following color development.

The processed samples were subjected to density measurement by using a green filter. The obtained photographic performance results of samples 1 to 13 are listed in Table 2.

Development was performed under the following conditions at a temperature of 38° C.

1. Color Development . . . 2 min. 45 sec.
2. Bleaching . . . 6 min. 30 sec.
3. Washing . . . 3 min. 15 sec.
4. Fixing . . . 6 min. 30 sec.
5. Washing . . . 3 min. 15 sec.
6. Stabilizing . . . 3 min. 15 sec.

The compositions of processing solutions used in the above steps were as follows.

| | |
|---|---|
| Color Developing solution: | |
| Sodium Nitrilotriacetic Acid | 1.4 g |
| Sodium Sulfite | 4.0 g |
| Sodium Carbonate | 30.0 g |
| Potassium Bromide | 1.4 g |
| Hydroxylamine Sulfate | 2.4 g |
| 4-(N-ethyl-N-β-hydroxyethylamino)-2-methyl-aniline Sulfate | 4.5 g |
| Water to make | 1 l |
| Bleaching Solution: | |
| Ammonium Bromide | 160.0 g |
| Ammonia Water (28 w/w) | 25.0 ml |
| Ammonium Ethylenediamine tetraacetate Ferrate [III] | 100 g |
| Disodium Ethylendiamine-tetraacetate | 10 g |
| Glacial Acetic Acid | 14 ml |
| Water to make | 1 l |
| Fixing Solution: | |
| Sodium Tetrapolyphosphate | 2.0 g |
| Sodium Sulfite | 4.0 g |
| Ammonium Thiosulfate (70%) | 175.0 ml |
| Sodium Bisulfite | 4.6 g |
| Water to make | 1 l |
| Stabilizing Solution: | |
| Formalin | 8.0 ml |
| Water to make | 1 l |

Normal wedge exposure was performed both for 1 sec. and for 1/100 sec.

A light source was adjusted at a color temperature of 4,800° K. by using a filter, and blue light was extracted by using blue filter (BPN42: available from a Fuji Photo Film Co. Ltd.) or a yellow fillter. Sensitivities were compared using density at a point from a fog by an optical density of 0.2.

Gamma in Table 2, which is one of photographic properties, was the slope of a characteristic curve, and its value indicates image contrast. Sensitivity was measured, using the blue-sensitivity of octahedral grains of sample 1, which is 100, as reference. The emulsion containing tabular grains exhibit a low sensitivity because they do no scatter much light. Since the light scattered by the tabular grains is not intense, the emulsion is disadvantageous in terms of light-sensitivity, but is advantageous in terms of image-sharpness. Nevertheless, it is confirmed that the blue-sensitivity of the emulsion containing the tabular grains are remarkably increased by adding a blue spectral sensitizing dye to the emulsion.

Generally, the emulsion containing layered grains are superior to that containing homogeneous octahedral grains in light-sensitivity and fogging, but inferior in contrast, as is evident from the comparison of samples 1 and 3. As is evident from the data on samples 2 and 4, a layered grain and a homogeneous octahedral grain are different in the effectiveness of the oxidizing agent for silver used. The sensitivity a little increases and contrast of the emulsion containing layered grains much increases as the fogging property diminishes. The same trend is observed in the emulsion containing homogeneous tabular grains, layered tabular grains, or epitaxial tabular grains. In other words, the emulsion containing layered grains or the epitaxial grains have low contrast, though they have very high sensitivity and excellent fogging property.

The emulsion according to this invention whose grains have a layered or epitaxial structure, have not only high sensitivity and low fog but also sufficient contrast, because thiosulfonic acid and hydrogen peroxide are added as silver-oxidizing agents to the emulsion.

TABLE 2

| Sample No. | Emulsion | Shape/Structure | Oxidizing agent | Fogging | Blue-Sensitivity | Gamma | |
|---|---|---|---|---|---|---|---|
| 1 | I | Octahedron/Homogeneous | | 0.28 | 100 | 0.90 | Com. Ex. |
| 2 | " | " | 1-2 | 0.22 | 95 | 0.92 | " |
| 3 | II | Octahedron/Layered | | 0.18 | 480 | 0.78 | " |
| 4 | " | " | 1-2 | 0.16 | 520 | 0.95 | Invention |
| 5 | III | Tabular/Homogeneous | | 0.26 | 70 | 0.85 | Com. Ex. |
| 6 | " | " | 1-2 | 0.21 | 67 | 0.87 | " |
| 7 | IV | Tabular/Hemogeneous | | 0.20 | 220 | 0.78 | " |
| 8 | " | " | 1-2 | 0.18 | 250 | 0.87 | Invention |
| 9 | " | " | 1-6 | 0.17 | 240 | 0.88 | " |
| 10 | " | " | 1-16 | 0.17 | 230 | 0.87 | " |
| 11 | " | " | $H_2O_2$ | 0.16 | 200 | 0.85 | " |
| 12 | V | Tabular/Epstaxial | | 0.27 | 170 | 0.80 | Com. Ex. |
| 13 | " | " | 1-2 | 0.20 | 180 | 0.88 | Invention |

EXAMPLE 2

The dyes II to IX, which are listed in Table B below, were added to samples Nos. 5 to 8 of the chemically sensitized emulsions, which had been prepared in Example 1, thereby forming a red-sensitive emulsion, a green-sensitive emulsion, and a blue-sensitive emulsion.

| | |
|---|---|
| Dye Group 1 (Red-Sensitive Dyes) | |
| Sensitizing Dye IX | $5.4 \times 10^{-5}$ *mol/mol Ag* |
| Sensitizing Dye II | $1.4 \times 10^{-5}$ *mol/mol Ag* |
| Sensitizing Dye III | $2.4 \times 10^{-4}$ *mol/mol Ag* |
| Sensitizing Dye IV | $3.1 \times 10^{-5}$ *mol/mol Ag* |
| Dye Group 2 (Green-Sensitive Dyes) | |
| Sensitizing Dye V | $3.5 \times 10^{-5}$ *mol/mol Ag* |
| Sensitizing Dye VI | $8.0 \times 10^{-5}$ *mol/mol Ag* |
| Sensitizing Dye VII | $3.0 \times 10^{-4}$ *mol/mol Ag* |
| Dye Group 3 (Blue-Sensitive Dyes) | |
| Sensitizing Dye VIII | $2.2 \times 10^{-4}$ *mol/mol Ag* |

18 layers specified below containing these emulsions were coated on triacetyl celluose film supports having an undercoating layer, thereby preparing multi-layer color photographic materials. (Composition of the Light-Sensitive Layer)

Numerals corresponding to the respective components indicate coating amounts in units of g/m$^2$. The coating amounts of silver halide and colloid silver are represented by a silver amount. The coating amounts of the sensitizing dyes are represented in units of mols per mol of silver halide in the same layer.

| | |
|---|---|
| Layer 1: Antihalation Layer | |
| Black Colloid Silver | 0.2 |
| Gelatin | 2.2 |
| UV-1 | 0.1 |

-continued

| | |
|---|---|
| UV-2 | 0.2 |
| Cpd-1 | 0.04 |
| Cpd-2 | 0.02 |
| Solv-1 | 0.30 |
| Solv-2 | 0.01 |
| Layer 2: Interlayer | |
| Fine Silver Iodobromide Grain (1.0 mol % of AgI, sphare-equivalent diameter: 0.07 μm) coating silver amount | 0.15 |
| Gelatin | 1.0 |
| ExC-4 | 0.03 |
| Cpd-3 | 0.2 |
| Layer 3: First Red-Sensitive Emulsion Layer | |
| Silver Iodobromide Emulsion (5.0 mol % of AgI, externally high-AgI type; tabular grains having a sphere-equivalent diameter of 0.9 μm, a variation coefficient (in sphere-equivalent diameter) of 21%, and a diameter/thickness ratio of 7.5) coating silver amount | 0.42 |
| Silver Iodobromide Emulsion (4.0 mol % of AgI, internally high-AgI type; tetradecahedral grains having a sphere-equivalent diameter of 0.4 μm, a variation coefficient of 0.4 μm, sphere-equivalent diameter) of 18%) coating silver amount | 0.40 |
| Gelatin | 1.0 |
| ExS-1 | $4.5 \times 10^{-4}$ *mol* |
| ExS-2 | $1.5 \times 10^{-4}$ *mol* |
| ExS-3 | $0.4 \times 10^{-4}$ *mol* |
| ExC-1 | 0.50 |
| ExC-2 | 0.11 |
| ExC-3 | 0.009 |
| ExC-4 | 0.023 |
| Solv-1 | 0.24 |
| Layer 4: Second Red-Sensitive Emulsion Layer | |
| Silver Iodobromide Emulsion (8.5 mol % of AgI, internally high-AgI type; tabular grains having a sphere-equivalent diameter of 1.0 μm, a variation coefficient (in sphere-equivalent diameter) of 25%, and a diameter/thickness ratio of 3.0) coating silver amount | 0.85 |
| Gelatin | 0.7 |
| ExS-1 | $3 \times 10^{-4}$ *mol* |
| ExS-2 | $1 \times 10^{-4}$ *mol* |
| ExS-3 | $0.3 \times 10^{-4}$ *mol* |
| ExC-1 | 0.10 |
| ExC-2 | 0.05 |
| ExC-4 | 0.025 |
| Solv-1 | 0.10 |
| Layer 5: Third Red-Sensitive Emulsion Layer | |
| Silver Iodobromide Emulsion 1 coating silver amount | 1.50 |
| Gelatin | 0.6 |
| ExC-2 | 0.08 |
| ExC-4 | 0.01 |

-continued

| | |
|---|---|
| ExC-5 | 0.06 |
| Solv-1 | 0.12 |
| Solv-2 | 0.12 |
| Layer 6: Interlayer | |
| Gelatin | 1.0 |
| Cpd-4 | 0.1 |
| Solv-1 | 0.1 |
| Layer 7: First Green-Sensitive Emulsion Layer | |
| Silver Iodobromide Emulsion (5.0 mol % of AgI, externally high-AgI type; tabular grains having a sphere-equivalent diameter of 0.9 μm, variation coefficient (in equivalent diameter) of 21%, and a diameter/thickness ratio of 7.0) coating silver amount | 0.28 |
| Silver Iodobromide Emulsion (4.0 mol % of AgI, internally high-AgI type; tetradecahedral grains having a sphere-equivalent diameter of 0.4 μm, a variation coefficient (in sphere-equivalent diameter) of 18%) coating silver amount | 0.16 |
| Gelatin | 1.2 |
| ExS-5 | $5 \times 10^{-4}$ *mol* |
| ExS-6 | $2 \times 10^{-4}$ *mol* |
| ExS-7 | $1 \times 10^{-4}$ *mol* |
| ExM-1 | 0.50 |
| ExM-2 | 0.10 |
| Solv-1 | 0.2 |
| Solv-4 | 0.03 |
| Layer 8: Second Green-Sensitive Emulsion Layer | |
| Silver Iodobromide Emulsion (8.5 mol % of AgI, externally high-I type; tabular grains having a sphere-equivalent diameter of 1.0 μm, a variation coefficient (in sphere-equivalent diameter) of 25%, and a diameter/thickness ratio of 3.0) coating silver amount | 0.57 |
| Gelatin | 0.35 |
| ExS-5 | $3.5 \times 10^{-4}$ *mol* |
| ExS-6 | $1.4 \times 10^{-4}$ *mol* |
| ExS-7 | $0.7 \times 10^{-4}$ *mol* |
| ExM-1 | 0.12 |
| ExM-2 | 0.01 |
| ExM-3 | 0.03 |
| Solv-1 | 0.15 |
| Solv-4 | 0.03 |
| Layer 9: Interlayer | |
| Gelatin | 0.5 |
| Solv-1 | 0.02 |
| Layer 10: Third Green-Sensitive Emulsion Layer | |
| Silver Iodobromide Emulsion II coating silver amount | 1.3 |
| Gelatin | 0.8 |
| ExM-4 | 0.04 |
| ExC-4 | 0.005 |
| ExM-6 | 0.01 |
| Cpd-5 | 0.01 |
| Solv-1 | 0.2 |
| Layer 11: Yellow Filter Layer | |
| Cpd-6 | 0.05 |
| Gelatin | 0.5 |
| Solv-1 | 0.1 |
| Layer 12: Interlayer | |
| Gelatin | 0.5 |
| Cpd-3 | 0.1 |
| Layer 13: First Blue-Sensitive Emulsion Layer | |
| Silver Iodobromide Emulsion (2 mol % of AgI, homogeneous I type; tabular grains having a sphere-equivalent diameter of 0.55 μm, a variation coefficient (in sphere-equivalent diameter) of 25%, and a diameter/thickness ratio of 7.0) coating silver amount | 0.2 |
| Gelatin | 1.0 |
| ExS-8 | $3 \times 10^{-4}$ *mol* |

-continued

| | |
|---|---|
| ExY-1 | 0.6 |
| ExY-2 | 0.02 |
| Solv-1 | 0.15 |
| Layer 14: Second Blue-Sensitive Emulsion Layer | |
| Silver Iodobromide Emulsion (19.0 mol % of AgI, internally high-AgI type; octahedral grains having a sphere-equivalent diameter of 1.0 μm, a variation coefficient (in sphere-equivalent diameter) of 16%) coating silver amount | 0.19 |
| Gelatin | 0.3 |
| ExS-8 | $2 \times 10^{-4}$ *mol* |
| ExY-1 | 0.22 |
| Solv-1 | 0.07 |
| Layer 15: Interlayer | |
| Fine grains silver iodobromide (2 mol % of AgI, homogeneous I type, sphare-equivalent diameter of 0.13 μm) coating silver amount | 0.2 |
| Gelatin | 0.36 |
| Layer 16: Third Blue-Sensitive Emulsion Layer | |
| Silver Iodobromide Emulsion III coating silver amount | 1.55 |
| Gelatin | 0.5 |
| ExY-1 | 0.2 |
| Solv-1 | 0.07 |
| Layer 17: First Protective Layer | |
| Gelatin | 1.8 |
| UV-1 | 0.1 |
| UV-2 | 0.2 |
| Solv-1 | 0.01 |
| Solv-2 | 0.01 |
| Layer 18: Second Protective Layer | |
| Fine Silver Chloride Grain (sphere-equivalent diameter of 0.07 μm) coating silver amount | 0.36 |
| Gelatin | 0.7 |
| Polymethylmethacrylate Grains (diameter of 1.5 μm) | 0.2 |
| W-1 | 0.02 |
| H-1 | 0.4 |
| Cpd-7 | 1.0 |

In addition to the above additive, B-1 (0.20 g/m$^2$ in total), 1,2-benziisothiazoline-3-one (about 200 ppm on the average with respect of gelatin), n-butyl, p-hydroxybenzoate (about 1,000 mmp on the average with respect of gelain), and 1-phenoxyethanol (about 10,000 ppm on the average with respect of gelatin).

The compounds identified above with symbols are as Table C below.

These samples were subjected to sensitometry exposure, and then to the following color development. The color-developed samples were subjected to density measurement, which was performed by means of red, green, and blue filters.

The color development was carried out at 38° C., in the following steps:

| | |
|---|---|
| Color Development | 3 min. 15 sec. |
| Bleaching | 6 min. 30 sec. |
| Washing | 2 min. 10 sec. |
| Fixing | 4 min. 20 sec. |
| Washing | 3 min. 15 sec. |
| Stabilization | 1 min. 05 sec. |

The solutions applied in the processing described above were as follows:

| | |
|---|---|
| Color Develper: | |
| Diethylenetriaminepentaacetic Acid | 1.0 g |

-continued

| | |
|---|---|
| 1-hydroxyethylidene-1,1-diphosphonic Acid | 2.0 g |
| Sodium Sulfite | 4.0 g |
| Potassium Carbonate | 30.0 g |
| Potassium Bromide | 1.4 g |
| Potassium Iodide | 1.3 mg |
| Hydroxylamine Sulfate | 2.4 g |
| 4-(N-ethyl-N-β-hydroxyethylamino)-2-methylanilinesulfate | 4.5 g |
| Water to make | 1.0 l |
| pH | 10.0 |
| Bleaching Solution: | |
| Ferric Ammonium Ethylenediaminetetraacetate | 100.0 g |
| Disodium Ethylenediaminetetraacetate | 10.0 g |
| Ammonium Bromide | 150.0 g |
| Ammonium Nitrate | 10.0 g |
| Water to make | 1.0 l |
| pH | 6.0 |
| Fixing Solution: | |
| Disodium Ethylenediaminetetraacetate | 1.0 g |
| Sodium Sulfite | 4.0 g |
| Ammonium Thiosulfate Aqueous Solution (70%) | 175.0 ml |
| Sodium Bisulfite | 4.6 g |
| Water to make | 1.0 l |
| pH | 6.6 |
| Stabilizing Solution: | |
| Formalin (40%) | 2.0 ml |
| Polyoxyethylene-p-monononyl-phenylether (average polymerization degree = 10) | 0.3 g |
| Water to make | 1.0 l |

The samples 203 (emulsion No. 7) were much superior to the samples 201 (emulsion No. 5) in both light-sensitivity and fogging property, just as in the case of the single-coating samples. However, they formed images of solt tone and low contrast. The samples 204 (emulsion No. 8) exhibited good photographic properties; that is, they had light sensitivity somewhat higher than that of the samples 201, and image contrast similar to that of the samples 201. Such good photo graphic properties were not found in the samples 202 (emulsion No. 6). Hence, it is understood that a combination of grains having a specific structure and oxidizing agent for silver serves to provide good photo graphic properties.

EXAMPLE 3

The samples 201 to 204 were exposed in the same way as in Example 2. Then, they were processed by means of an automatic developing machine, under the following conditions:

| Step | Processing Method Time | Temperature |
|---|---|---|
| Color Development | 3 min. 15 sec. | 38° C. |
| Bleaching | 1 min. 00 sec. | 38° C. |
| Bleach-Fixing | 3 min. 15 sec. | 38° C. |
| Washing (1) | 40 sec. | 35° C. |
| Washing (2) | 1 min. 00 sec. | 35° C. |
| Stabilizing | 40 sec. | 38° C. |
| Dry | 1 min. 15 sec. | 55° C. |

The processing solution compositions will be described below.

| | (g) |
|---|---|
| Color Developing Solution: | |
| Diethylenetriaminepentaacetic Acid | 1.0 |
| 1-hydroxyethylidene-1,1 diphosphonic acid | 3.0 |
| Sodium Sulfite | 4.0 |
| Potassium Carbonate | 30.0 |
| Potassium Bromide | 1.4 |
| Potassium Iodide | 1.5 mg |
| Hydroxylamine Sulfate | 2.4 |
| 4-[N-ethyl-N-(β-hydroxyethyl)amino]-2-methylanilinesulfate | 4.5 |
| Water to make | 1.0 L |
| pH | 10.05 |
| Bleaching Solution: | |
| Ferric Ammonium Ethylenediaminetetraacetate (Dihydrate) | 120.0 |
| Disodium Ethylenediaminetetraacetate | 10.0 |
| Ammonium Bromide | 100.0 |
| Ammonium Nitrate | 10.0 |
| Bleaching Accelerator | 0.005 mol |

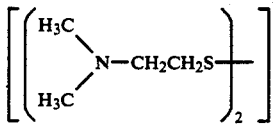

| | |
|---|---|
| Ammonia Aqueous Solution (27%) | 15.0 ml |
| Water to make | 1.0 L |
| pH | 6.3 |
| Bleach-Fixing Solution: | |
| Ferric Ammonium Ethylenediaminetetraacetate (Dihydrate) | 50.0 |
| Disodium Ethylenediaminetetraacetate | 5.0 |
| Sodium Sulfite | 12.0 |
| Ammonium Thiosulfate Aqueous Solution (70%) | 240.0 ml |
| Ammonium Aqueous Solution | 6.0 ml |
| Water to make | 1.0 L |
| pH | 7.2 |
| Washing Solution: | |
| Tap water was supplied to a mixed-bed column filled with an H type strongly acidic cation exchange resin (Amberlite IR-120B: available from Rohm & Haas Co.) and an OH type strongly basic anion exchange resin (Amberlite IR-400) to set the concentrations of calcium and magnesium to be 3 mg/L or less. Subsequently, 20 mg/L of dichlorinated sodium isocyanurate and 1.5 g/L of sodium sulfate were added. The pH of the solution fell within the range of 6.5 to 7.5. | |
| Stabilizing Solution: | |
| Formalin (37%) | 2.0 ml |
| Polyoxyethylene-p-monononyl-phenylether (average polymerization degree = 10) | 0.3 |
| Disodium Ethylenediaminetetraacetate | 0.05 |
| Water to make | 1.0 L |
| pH | 5.0 to 8.0 |

The samples 204 of the present invention provided the good results as in Example 2 after they were subjected to the above processing.

EXAMPLE 4

The samples 201 to 204 of Example 2 were exposed, following the same procedure as in Example 3 and processed as follows by using an automatic developing machine.

| Step | Processing Method Time | Temperature |
|---|---|---|
| Color Development | 2 min. 30 sec. | 40° C. |
| Bleach-Fixing | 3 min. 00 sec. | 40° C. |
| Washing (1) | 20 sec. | 35° C. |
| Washing (2) | 20 sec. | 35° C. |
| Stabilizing | 20 sec. | 35° C. |
| Drying | 50 sec. | 65° C. |

The processing solution compositions will be described below.

| | (g) |
|---|---|
| Color Developing Solution: | |
| Diethylenetriaminepentaacetic Acid | 2.0 |
| 1-hydroxyethylidene-1,1 diphosphonic acid | 3.0 |
| Sodium Sulfite | 4.0 |
| Potassium Carbonate | 30.0 |
| Potassium Bromide | 1.4 |
| Potassium Iodide | 1.5 mg |
| Hydroxylamine Sulfate | 2.4 |
| 4-[N-ethyl-N-(β-hydroxyethyl)amino]-2-methylaniline Sulfate | 4.5 |
| Water to make | 1.0 L |
| pH | 10.05 |
| Bleaching-Fixing Solution: | |
| Ferric Ammonium Ethylenediaminetetraacetate (Dihydrate) | 50.0 |
| Disodium Ethylenediaminetetraacetate | 5.0 |
| Sodium Sulfite | 12.0 |
| Ammonium Thiosulfate Aqueous Solution (70%) | 260.0 ml |
| Acetic Acid (98%) | 5.0 ml |
| Bleaching Accelerator | 0.01 mol |

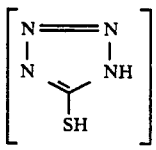

| | |
|---|---|
| Water to make | 1.0 L |
| pH | 6.0 |
| Washing Solution: | |
| Tap water was supplied to a mixed-bed column filled with an H type strongly acidic cation exchange resin (Amberlite IR-120B: available from Rohm & Haas Co.) and an OH type strongly basic anion exchange resin (Amberlite IR-400) to set the concentrations of calcium and magnesium to be 3 mg/L or less. Subsequently, 20 mg/L of sodium isocyanuric acid dichloride and 0.15 g/L of sodium sulfate were added. The pH of the solution fell within the range of 6.5 to 7.5. | |
| Stabilizing Solution: | |
| Formalin (37%) | 2.0 ml |
| Polyoxyethylene-p-monononyl-phenylether (average polymerization degree = 10) | 0.3 |
| Disodium Ethylenediaminetetraacetate | 0.05 |
| Water to make | 1.0 L |
| pH | 5.0 to 8.0 |

The samples 204 of the present invention provided the good results as in Example 2 after they were subjected to the above processing.

EXAMPLE 5

Four coating solutions were prepared by adding 4-(2-[2-methyl-(3-[4-sulfonathobutyl] benzothiazoline-2-yliden)-1-propenyl-] 3-benothiazolyo) butane sulfonate pyridinium, used as a spectral sensitizer in an amount of 0.36 millimols per mol of silver halide, tetra-azaindene used as a stabilizer dodecylbenzene sulfonate used as a coating aid, and polypotassium-p-vinylbenzone sulfonate used as a viscosity-increasing agent, to the emulsions Nos. 5, 6, 7, and 8. These coating solutions were coated on support films made of triacetyl cellulose, along with a surface protective layer, thus preparing samples 501 to 504 of photosensitive material.

The surface protective layers were made of a 10 wt % aqueous solution of gelatin, which contains, besides gelatin, polystyrene sulfonic soda (i.e., viscosity-increasing agent), mat agent, N,N'-ethylene bis (vinylsulfonylamide) (i.e., hardening agent), and sodium t-octylphenoxyethoxy-ethoxyethanesulfonate (i.e., coating aid). Each photosensitive silver halide emulsion was coated in such an amount that 3.5 g of silver was coated on each square meter, and the gelatin aqueous solution was coated such that 1.3 g of gelatin was coated on each square meter, thus forming a layer having a thickness of 1.0 μm.

Light was from a 400-lux tungsten lamp applied to the samples 501 to 504 through an optical wedge, for 1/10 second, thereby exposing these samples. Then, the samples were developed with the developer at 20° C., first for 7 minutes and then for 12 minutes. The developed samples were subjected to fixing, washing, and drying. Thereafter, the sensitivities of the samples 501 to 504 were measured at optical density of 0.1 which is higher than fogging density.

| | |
|---|---|
| Developing Solution: | |
| Metol (trade name) | 2 g |
| Sodium Sulfite | 100 g |
| Hydroquinone | 5 g |
| Borax $5H_2O$ | 1.53 g |
| Water to make | 1 l |
| Fixing Solution: | |
| Ammonium Thiosulfate | 200.0 g |
| Sodium Sulfite (Anhydrous)(?) | 20.0 g |
| Boric Acid | 8.0 g |
| Disodium Ethylinediamine-tetraacetate | 0.1 g |
| Aluminum Sulfide | 15.0 g |
| Sulfuric Acid | 2.0 g |
| Glacial Acetic Acid | 22.0 g |
| Water to make | 1.0 l |
| (pH was adjusted to 4.2.) | |

The samples 503 (emulsion 7) were greatly superior to the samples 501 (emulsion No. 5) in both light-sensitivity and fogging property, but were inferior in terms of image contrast in the black-and-white development. The samples 504 (emulsion No. 8) exhibited good photographic proper ties; that is, they had light sensitivity somewhat higher than that of the samples 503, and image contrast similar to that of the samples 201. Such good photographic properties were not found in the samples 502 (emulsion No. 6).

TABLE A

| | |
|---|---|
| $CH_3SO_2SNa$ | (I-1) |
| $C_2H_5SO_2SNa$ | (I-2) |

TABLE A-continued
$C_3H_7SO_2SK$ (I-3)
$C_4H_9SO_2SLi$ (I-4)
$C_6H_{13}SO_2SNa$ (I-5)
$C_8H_{17}SO_2SNa$ (I-6)
$CH_3(CH_2)_3CH(C_2H_5)CH_2SO_2S.NH_4$ (I-7)
$C_{10}H_{21}SO_2SNa$ (I-8)
$C_{12}H_{25}SO_2SNa$ (I-9)
$C_{16}H_{33}SO_2SNa$ (I-10)
$(CH_3)_2CH-SO_2SK$ (I-11)
$t\text{-}C_4H_9SO_2SNa$ (I-12)
$CH_3OCH_2CH_2SO_2S.Na$ (I-13)
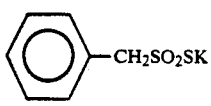
(I-14)
$CH_2{=}CHCH_2SO_2SNa$ (I-15)
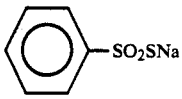
(I-16)
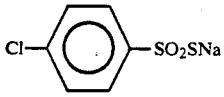
(I-17)
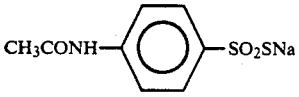
(I-18)
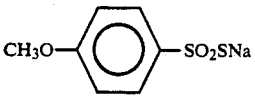
(I-19)
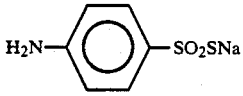
(I-20)
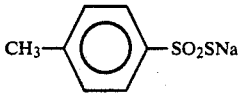
(I-21)
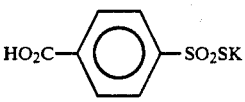
(I-22)
TABLE A-continued
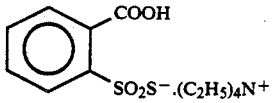
(I-23)
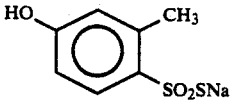
(I-24)
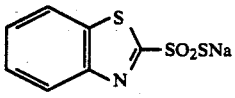
(I-25)
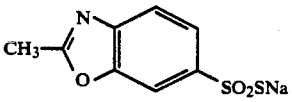
(I-26)
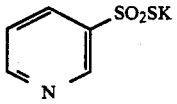
(I-27)
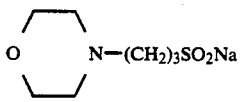
(I-28)
$KSSO_2(CH_2)_2SO_2SK$ (I-29)
$NaSSO_2(CH_2)_4SO_2SNa$ (I-30)
$NaSSO_2(CH_2)_4S(CH_2)_4SO_2SNa$ (I-31)
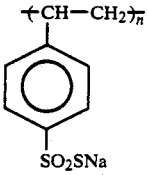
(I-32)
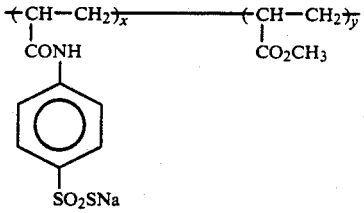
(I-33)
x:y = 1/1
(mol ratio)
$C_2H_5SO_2S-CH_3$ (2-1)
$C_8H_{17}SO_2SCH_2CH_3$ (2-2)
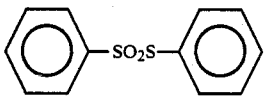
(2-3)
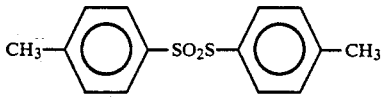
(2-4)
$C_2H_5SO_2SCH_2CH_2CN$ (2-5)

TABLE A-continued
(2-6)
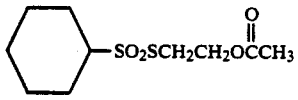
(2-7)
$C_4H_9SO_2SCH(CH_3)CH_2CN$
(2-8)
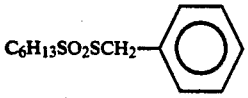
(2-9)
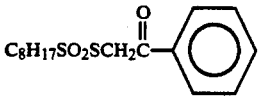
(2-10)
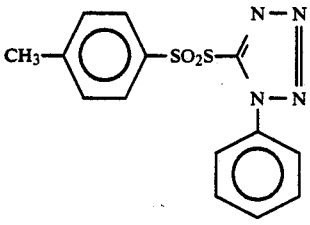
(2-11)
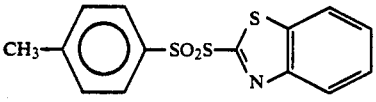
(2-12)
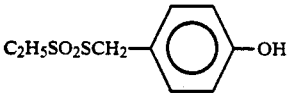
(2-13)
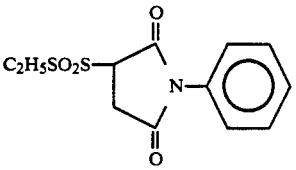
(2-14)
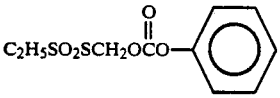
(2-15)
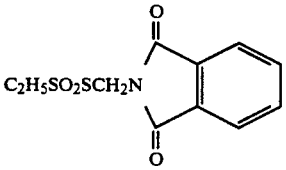
(2-16)
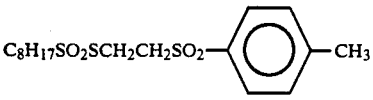
(2-17)
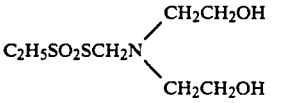
TABLE A-continued
$C_2H_5SO_2SCH_2CH_2CH_2CH_2OH$ (2-18)
(2-19)
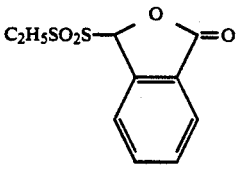
(2-20)
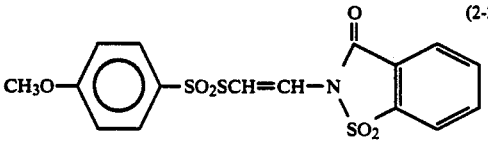
$CH_3SSO_2(CH_2)_4SO_2SCH_3$ (2-21)
$CH_3SSO_2(CH_2)_2SO_2SCH_3$ (2-22)
(2-23)
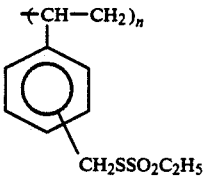
(2-24)
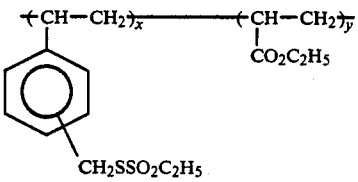
x:y = 2/1
(mol ratio)
(2-25)
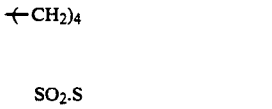
(3-1)
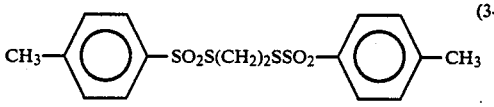
$C_2H_5SO_2SCH_2CH_2SO_2CH_2CH_2CH_2SSO_2C_2H_5$ (3-2)
(3-3)
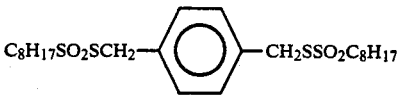
$C_2H_5SO_2SCH_2N(CH_2CH_2OH)CH_2CH_2N(CH_2CH_2OH)CH_2SSO_2C_2H_5$ (3-4)
(3-5)
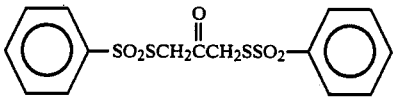
(3-6)
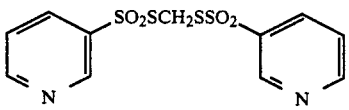
$C_2H_5SO_2SSSO_2C_2H_5$ (3-7)

TABLE A-continued
| | |
|---|---|
| $(n)C_3H_7SO_2SSSO_2C_3H_7(n)$ | (3-8) |
| 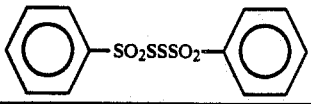 | (3-9) |
TABLE B
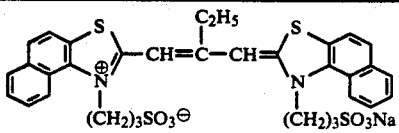
II
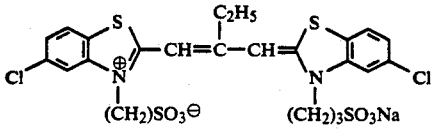
III
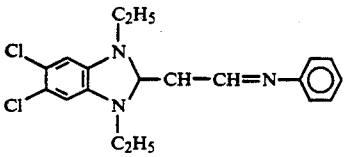
IV
TABLE B-continued
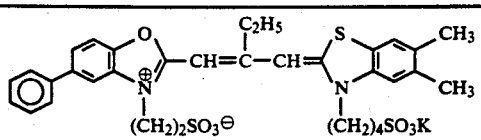
V
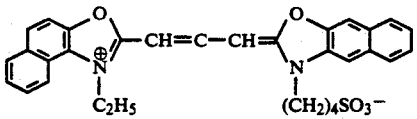
VI
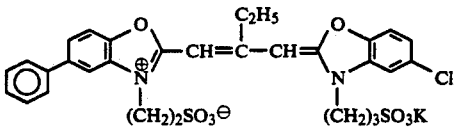
VII
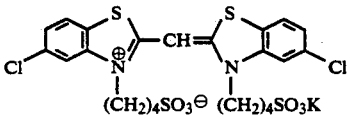
VIII
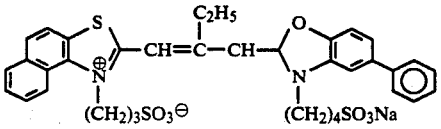
IX
TABLE C
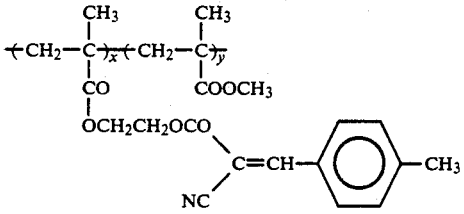
UV-1
x/y = 7/3 (weight ratio)
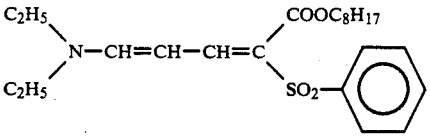
UV-2
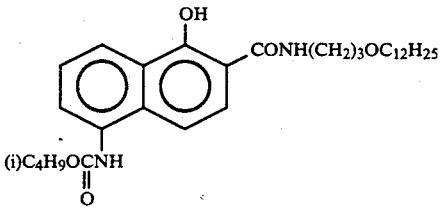
ExC-1
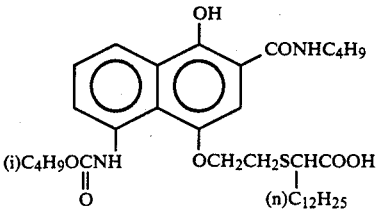
ExC-2

TABLE C-continued
ExC-3
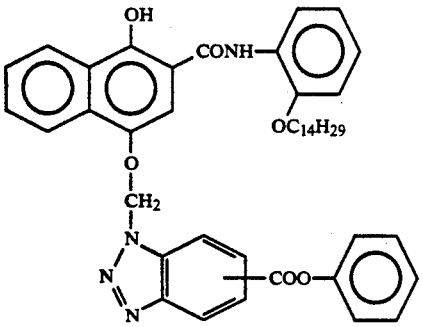
ExC-4
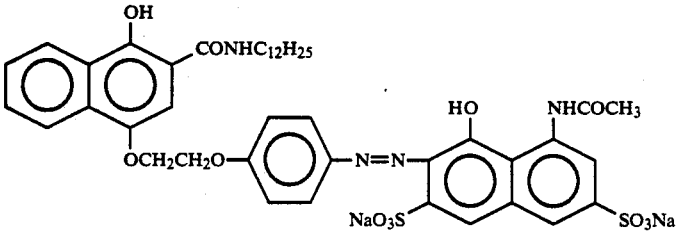
ExC-5
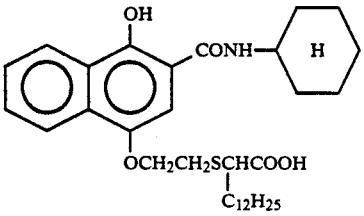
ExM-1
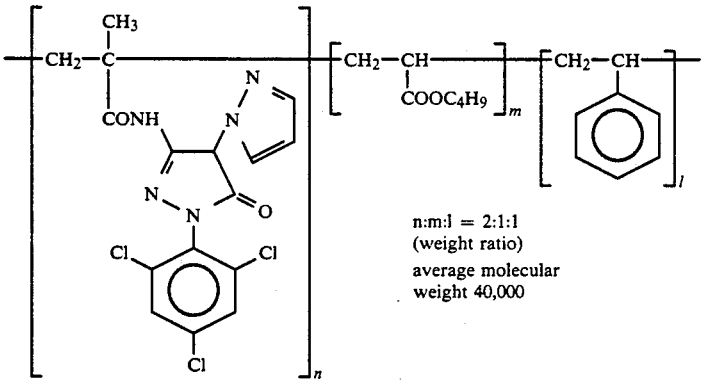
ExM-2
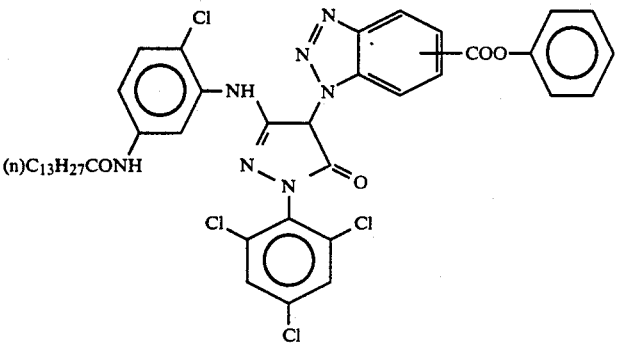

TABLE C-continued
ExM-3
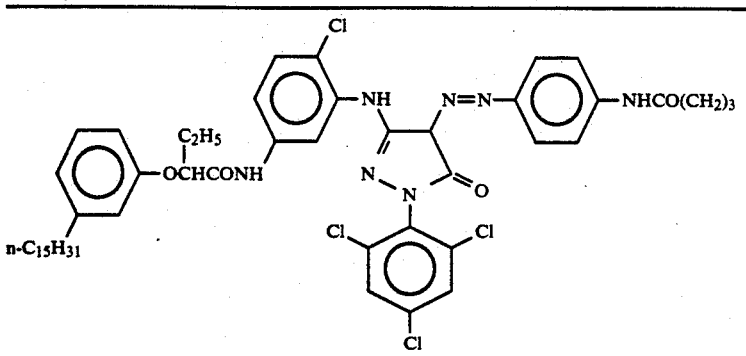
ExM-4
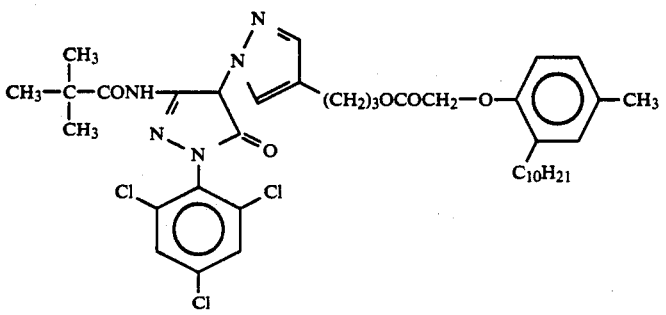
ExM-5
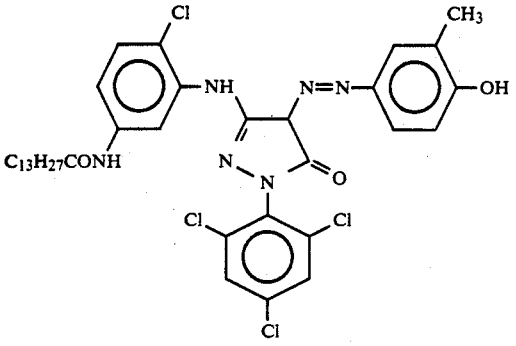
ExM-6
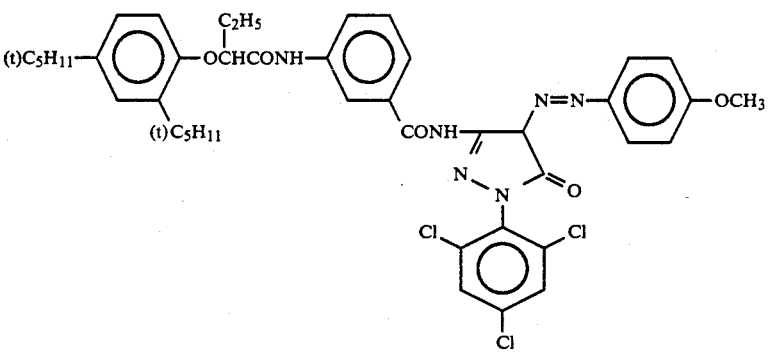
ExY-1
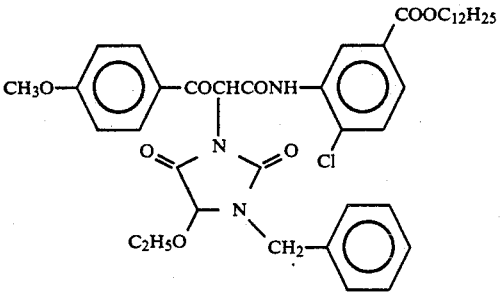

TABLE C-continued
ExY-2
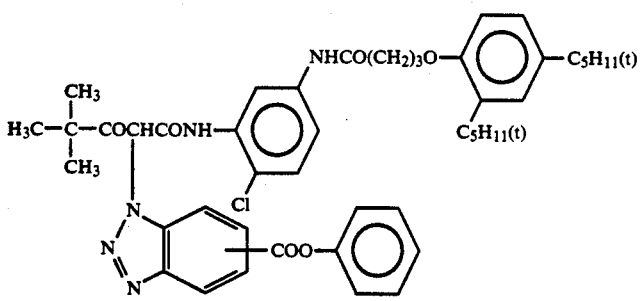
Cpd-1
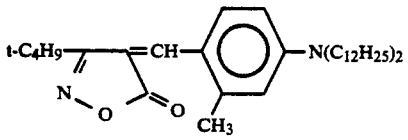
Cpd-2
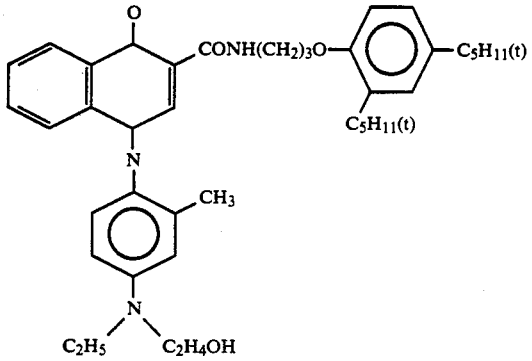
Cpd-3
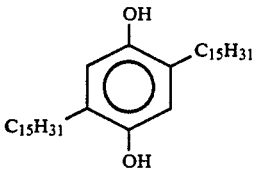
Cpd-4
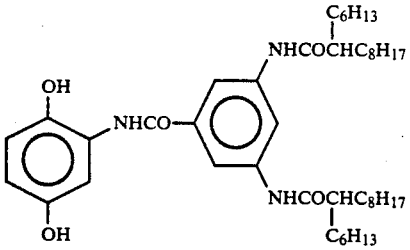
Cpd-5
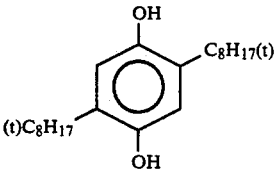
Cpd-6
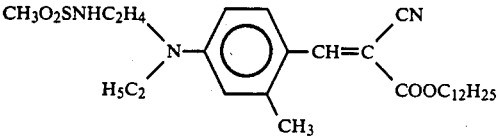

TABLE C-continued
Cpd-7
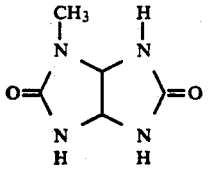
W-1
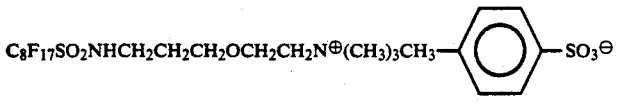
H-1
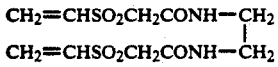
B-1
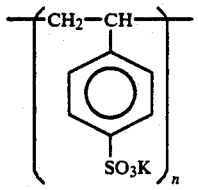
Solv-1
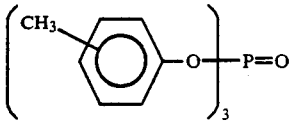
Solv-2
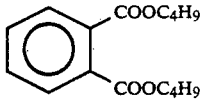
Solv-4
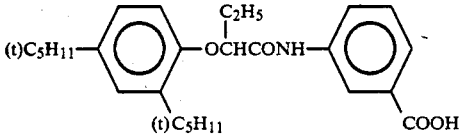
ExS-1
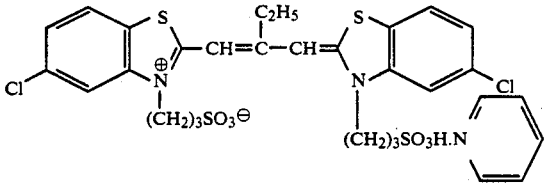
ExS-2
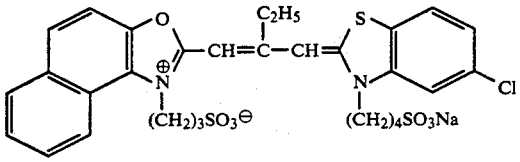
ExS-3
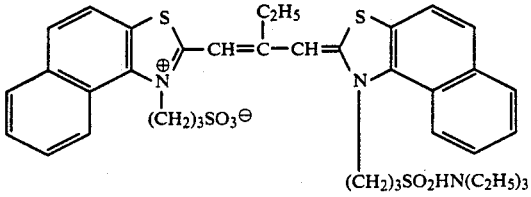

TABLE C-continued

ExS-5

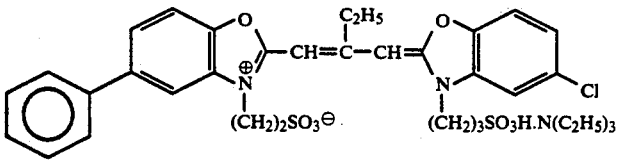

ExS-6

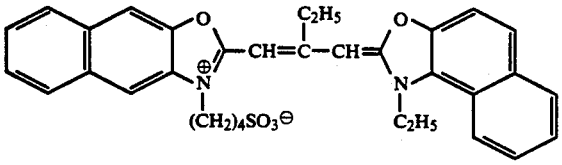

ExS-7

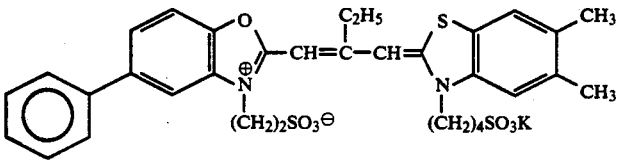

ExS-8

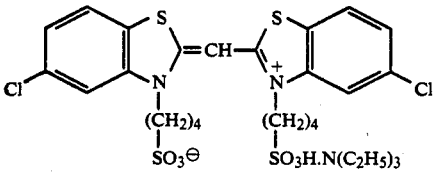

ExS-9

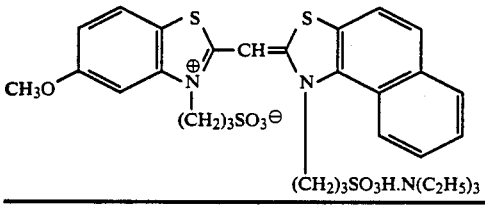

What is claimed is:

1. A negative-type silver halide photographic light-sensitive material comprising a support and at least one negative-type silver halide emulsion layer formed on the support, said emulsion layer containing chemically sensitized silver halide grains each of which has at least one structure resulting from the difference in halogen compositions, said grains having been prepared in the presence of an oxidizing agent for silver during or before grain formation and before chemical sensitization, wherein said oxidizing agent for silver is at least one selected from the group consisting of compounds represented by formulas (I), (II) and (III), and polymers having as a repeating unit a divalent group derived from the compounds of formula (I), (II) and (III):

$$R—SO_2S—M \quad (I)$$

$$R—SO_2S—R^1 \quad (II)$$

$$RSO_2S—Lm—SSO_2R^2 \quad (III)$$

where R, $R^1$, and $R^2$ are either the same or different and represent an aliphatic group, an aromatic group, or a heterocyclic group, M represents a cation, L represents a divalent linking group, and m is 0 or 1, wherein R, $R^1$, $R^2$ and L may combine together, forming a ring.

2. The silver halide photographic light-sensitive material according to claim 1, herein said structure resulting from the difference in halogen compositions comprises a layered structure including a core portion and at least one shell portion, said core and at least one layer of said shell portion having different halogen compositions.

3. The silver halide photographic light-sensitive material according to claim 1, wherein said structure resulting from the difference in halogen compositions comprises an epitaxial structure including a substrate grain and a portion epitaxially grown on the substrate grain, said substrate grain and said epitaxially grown portion having different halogen compositions.

4. The silver halide photographic light-sensitive material according to claim 1, wherein tabular grains having an aspect ratio of 3 or more account for 60% or more of the total projected surface area of said grains having at least one structure resulting from the difference in halogen compositions.

5. The silver halide photographic light-sensitive material according to claim 1, wherein tabular grains having an aspect ratio of 3 to 10 account for 60% or more of the total projected surface area of said grains having at least one structure resulting from the difference in halogen compositions.

6. The silver halide photographic light-sensitive material according to claim 1, wherein a size distribution of said grains having at least one structure resulting from the difference in halogen compositions is monodisperse with a variation coefficient of 25% or less.

7. The silver halide photographic light-sensitive material according to claim 1, wherein a size distribution of said grains having at least one structure resulting from the difference in halogen compositions is monodisperse with a variation coefficient of 20% or less.

8. The silver halide photographic light-sensitive material according to claim 1, wherein a size distribution of said grains having at least one structure resulting from the difference in halogen compositions is monodisperse with a variation coefficient of 15% or less.

9. The silver halide photographic light-sensitive material according to claim 1, wherein said emulsion is spectrally sensitized by a methine dye.

10. The silver halide photographic light-sensitive material according to claim 1, wherein said grains are gold-sensitized grains.

11. The silver halide photographic light-sensitive material according to claim 1, wherein each of said grains has an interface region between portions having different halogen compositions, said interface region having gradual different in the silver iodide content by 3 mol % or more.

12. The silver halide photographic light-sensitive material according to claim 1, wherein each of said grains has an interface region between portions having different halogen compositions, said interface region having a gradual difference in the silver iodide content by 5 mol % or more.

13. The silver halide photographic light-sensitive material according to claim 1, wherein each of said grains has an interface region between portions having different halogen compositions, said interface region having a gradual different in the silver iodide content by 10 mol % or more.

14. The negative-type silver halide photograph light-sensitive material according to claim 1, wherein said material is a silver halide color photographic light-sensitive material comprising support and at least one negative-type silver halide emulsion layer formed on the support, said emulsion layer containing chemically sensitized silver halide grains each of which has at least one structure resulting from the different in halogen compositions, said grains have been prepared in the presence off said oxidizing agent for silver during or before grain formation and before chemical sensitization.

* * * * *